United States Patent [19]

Gruber

[11] Patent Number: 4,875,724

[45] Date of Patent: Oct. 24, 1989

[54] HOOD LATCH MECHANISM

[75] Inventor: Herbert Gruber, Markham, Canada

[73] Assignee: Magna International Inc., Markham, Canada

[21] Appl. No.: 112,478

[22] Filed: Oct. 26, 1987

[30] Foreign Application Priority Data

Oct. 29, 1986 [CA] Canada ..... 521738

[51] Int. Cl.[4] ..... E05C 3/26

[52] U.S. Cl. ..... 292/216; 292/DIG. 14; 292/DIG. 65

[58] Field of Search ..... 292/216, 280, 25, 28, 292/DIG. 14, DIG. 65

[56] References Cited

U.S. PATENT DOCUMENTS 3,905,624 9/1975 Fujita ..... 292/DIG. 14 X 4,172,768 10/1979 Cerdan ..... 292/216

4,703,961 11/1987 Weinerman et al. ..... 292/216

*Primary Examiner*—Richard E. Moore

*Attorney, Agent, or Firm*—Ivor M. Hughes

[57] ABSTRACT

A latch mechanism comprising:

(a) a mounting plate carrying a slot having a bottom and mouth, (b) a pivotably biased pawl mechanism comprising a top arm portion for pivoting from a position over the slot to a position spaced from it, a bottom arm portion and follower apparatus, (c) a ratchet mechanism biased for rotation and carrying a notch having a mouth and control apparatus for controlling the follower apparatus of the pawl mechanism, and (d) stop means for stopping rotation of the ratchet mechanism with the mouth of the notch proximate the mouth of the slot both directed towards the top arm portion of the pawl, the top arm portion normally positioned over the slot and being precluded from movement away from the slot unless the mouth of the notch and mouth of the slot are both directed towards the top arm portion.

52 Claims, 13 Drawing Sheets

FIG.7 Physical Impossibility
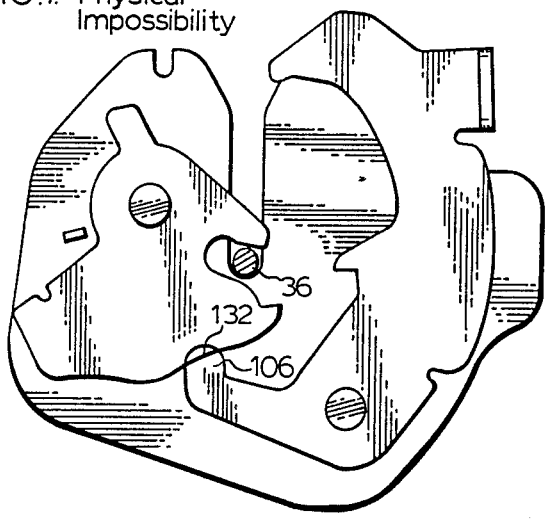
FIG.8.
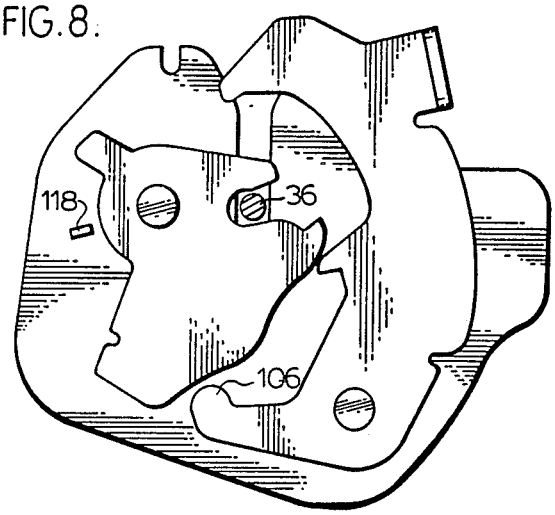

HOOD LATCH MECHANISM

FIELD OF INVENTION

This invention relates to latching mechanisms incorporated within a vehicle for use in retaining for example, hood lids potentially incorporating remote actuation.

BACKGROUND OF INVENTION

Many latching mechanisms have been proposed for securing hoods to the car body. Today with the emphasis on economy, proposals have attempted to simplify the mechanism. However, in the search for greater economy and simplicity, safety may be jeopardized. For example, where the latching mechanisms are frozen, parts may be frozen in a non-securing position and when the latch may be thought by the driver occupant to be fully secured, it may in fact not be so and the hood may suddenly fly open causing a very dangerous situation. These and other such like situations must be prevented.

U.S. Pat. No. 3,565,476 teaches a hood latch mechanism of complicated construction incorporating four separate components unlatched by a solenoid, having primary and secondary latching means released by a solenoid via a primary release lever engaging a pawl detent.

U.S. Pat. No. 4,203,621 discloses a latching mechanism having first and second latching means. Neither device is simple nor incorporates a co-operative positive secondary latching means which blocks the guide channel within the U-shaped housing upon accidental release of the striker by the primary latch.

U.S. Pat. No. 4,298,223 and United Kingdom patent application No. 2,061,369 each teach a simplified mechanism having a primary latch with a forwardly-biased secondary keeper preventing the primary latch from releasing until such time as the secondary keeper is disengaged. Again neither device blocks the guide channel within the U-shaped housing upon accidental release of the striker by the latch. Further, in neither device does a co-operative rearward stop mechanism exist for preventing over-rotation and hence potential damage for the ratchet mechanism.

Canadian letters patent Nos. 966,878 and 655,575 teach a simplified mechanism having a primary latch with a rearwardly-biased secondary keeper which may be remotely actuated, again having the aforementioned deficiency with no safety mechanisms therein incorporated.

Canadian letters patent No. 237,847 embodies a latch which may be used externally or internally again having no provision for accidental release, or co-operative engagement.

U.S. Pat. No. 3,378,289 discloses a latch mechanism for hoods and deck latches, each having a rotatable safety catch 108 (see FIG. 2) which co-operates with the actuation means of the device. Further, a stop mechanism arm 50 restricting the movement of latch member 46 is incorporated therein. However, the device has several primary components making the cost of manufacture in today's economy prohibitive. Further, the risk of mechanical failure for the system increases with the number of components thereof.

It is therefore an object of this invention to provide a latch mechanism of simplified construction which reduces the number of components therein, and yet retains all the necessary safety attributes, enhancing the locking and mechanical reliability of the latch.

It is a further object of this invention to provide a closure latch which is economical yet simple and safe to operate.

It is still a further object of this invention to provide a closure latch wherein both components co-operate with one another.

Further and other objects of this invention will become apparent to a man skilled in the art from the following summary of the invention and the detailed description of embodiments of the invention.

SUMMARY OF THE INVENTION

According to one aspect of the invention a latch mechanism is provided comprising (a) a mounting plate carrying a slot having a bottom and mouth, (b) a pivotably biased pawl mechanism comprising a top arm portion arranged for pivoting from a position over the slot to a position spaced from it, a bottom arm portion and follower means, (c) a ratchet mechanism biased for rotation and carrying a notch having a mouth and control means for controlling the follower means of the pawl mechanism, and (d) stop means with the latch mechanism for stopping rotation of the ratchet mechanism with the mouth of the notch proximate the mouth of the slot both directed towards the top arm portion of the pawl, the top arm normally positioned over the slot and being precluded from movement away from the slot unless the mouth of the notch and mouth of the slot are both directed towards the top arm portion.

According to another aspect of the invention, the control means for controlling the follower means of the pawl mechanism comprises a control surface on the ratchet mechanism and the follower means comprises a detent carried at the side edge of the pawl mechanism to engage the control surface to (a) lock the ratchet mechanism with any striker in the slot and notch at the bottom of the slot with the top arm covering the slot mouth, and (b) ensure the top arm portion cannot be pushed away from over the slot unless the mouth of the notch and mouth of the slot are both proximate one another and directed toward the top arm portion.

According to another aspect of the invention the control means for controlling the follower means comprises a control structure or formation carried by the ratchet mechanism (for example a slot formation through the body of the ratchet mechanism, in one embodiment a Z-shaped slot) and the follower means comprises a pin carried by the pawl mechanism (in one embodiment, the bottom arm portion).

According to another aspect of the invention, a latch mechanism is provided comprising a mounting plate carrying a slot having a bottom and mouth, a pivotably-biased pawl mechanism comprising a top arm portion (for pivoting from a position over the slot to a position spaced from it), a bottom arm portion, and follower and engaging means in one embodiment comprising a centrally disposed detent and in another embodiment comprising a pin or projection extending from the bottom arm and projecting through a slot in the mounting plate, a ratchet mechanism biased for rotation and carrying a notch having a mouth (the notch for receiving a striker), the plane of the ratchet in one embodiment lying in the same plane as the pawl mechanism and in another embodiment, lying in a plane spaced by the mounting plate from, and being parallel to, the plane of the pawl mechanism, control means for controlling the follower and said engaging means on the pawl mechanism in one embodiment comprising a substantially Z-shaped slot through the body of the ratchet mechanism for receiving the projection, the substantially Z-shaped slot comprising a centrally curved portion, in one embodiment being an arc of a circle about the pivot of the ratchet mechanism, a forward arm portion in communication with the centrally curved portion for carrying the projection when the notch of the ratchet mechanism is aligned with the bottom of the slot of the mounting plate and a rearward arm portion in communication with the centrally curved portion for permitting the top arm of the pawl mechanism to pivot from a position over the slot in the mounting plate to a position spaced from it and stop means to stop the rotation of the ratchet mechanism in one embodiment comprising the projection, the ratchet mechanism arranged for guiding the striker to proximate the bottom of the slot in one embodiment so that the detent of the pawl mechanism engages a detent of the ratchet mechanism and in another embodiment so that the projection is at the end of the forward arm portion remote from the centrally curved portion so that the ratchet mechanism is precluded from rotating to release the striker, the arm on the top of the pawl mechanism normally positioned over the slot and being precluded from movement away from the slot by the control means of the ratchet mechanism unless the mouth of the notch and mouth of the slot are both directed towards the top arm portion (in one embodiment, aligned) and whereby in one embodiment if the mouths of the notch and slot are not aligned but the striker is proximate the mouths of the notch and slot and the ratchet mechanism has not engaged the stop means but is proximate thereto, movement of the pawl mechanism away from the ratchet mechanism remote the notch in one embodiment the bottom arm portion of the pawl mechanism engages the ratchet mechanism and aligns the mouth of the notch with the mouth of the slot, and whereby in another embodiment pivoting of the pawl mechanism causes the projection to move in the centrally curved portion to its rearward position, thereby releasing the striker from the notch to permit the top arm to be pivoted away from over the slot.

According to one aspect of the invention a latch mechanism for securing for example a striker is provided comprising (a) a mounting plate carrying a slot having a bottom and a mouth, (b) a pivotably-biased pawl mechanism comprising, (i) a top arm for pivoting from a normal position over the slot to a position spaced from it, (ii) a bottom arm, and, (iii) follower and engaging means (in one embodiment comprising a centrally disposed detent and in another embodiment comprising a pin or projection extending from the bottom arm and projecting through a slot in the mounting plate), and (c) a ratchet mechanism biased for rotation and carrying, (i) a notch having a mouth, the notch for receiving for example the striker, and (ii) control means for controlling the follower and said engaging means on the pawl mechanism in one embodiment comprising a substantially Z-shaped slot through the body of the ratchet mechanism for receiving the projection, the substantially Z-shaped slot comprising a centrally curved portion (in one embodiment being an arc of a circle about the pivot of the ratchet mechanism), a forward arm portion in communication with the centrally curved portion for carrying the projection when the notch of the ratchet mechanism is aligned with the bottom of the slot of the mounting plate for stopping the striker at the bottom of the slot and a rearward arm portion in communication with the centrally curved portion for receiving the projection permitting the top arm of the pawl mechanism to pivot from a position over the slot in the mounting plate to a position spaced from it, when the mouth of the notch of the ratchet mechanism is aligned with the mouth of the slot, when the mouth of the notch of the ratchet mechanism is aligned with the mouth of the slot, the ratchet mechanism arranged for guiding the striker to proximate the bottom of the slot whereat in one embodiment the detent of the pawl mechanism engages the detent of the ratchet mechanism and in another embodiment whereat the projection is in the forward arm portion (in communication with the centrally curved portion) so that the ratchet mechanism is precluded from rotating to release the striker, the arm on the top of the pawl mechanism normally positioned over the slot and being precluded from movement away from the slot by the control means of the ratchet mechanism unless the mouth of the notch and mouth of the slot are both directed towards the top arm, in one embodiment being aligned, and whereby in one embodiment where the bottom arm portion of the pawl comprises engaging means preferably a projection or pin if the mouths of the notch and slot are not aligned but the striker is proximate the mouths of the notch and slot, movement of the pawl mechanism away from the ratchet mechanism remote the notch will engage the ratchet mechanism by the engaging means of the bottom arm of the pawl mechanism and align the mouth of the notch with the mouth of the slot, and whereby in another embodiment the pivoting of the pawl mechanism causes the projection to be moved in the centrally curved portion to the rearward position of the centrally curved portion thereby positioning the ratchet to release the striker from the notch wherein the control means of the ratchet will permit the top arm of the pawl to be pivoted away from over the slot.

According to another aspect of the invention, a latch mechanism is provided comprising a mounting plate carrying a slot having a mouth, a pivotably-biased pawl mechanism comprising a top arm and bottom arm and centrally disposed detent, a ratchet mechanism biased for rotation carrying a notch having a mouth (the plane of the ratchet mechanism lying in the same plane as the pawl mechanism), a detent on one side of the notch for engaging the detent of the pawl mechanism for precluding the rotation of the ratchet mechanism, the mouth of the notch of the ratchet mechanism for aligning with the mouth of the slot for both receiving a striker, and stop means to stop the rotation of the ratchet mechanism when the notch is aligned with the slot to prevent over-rotation of the ratchet mechanism, the ratchet mechanism arranged for guiding the striker to proximate the bottom of the slot when the detent of the pawl engages the detent of the ratchet mechanism precluding the ratchet mechanism from rotating to release the striker, the arm on the top of the pawl mechanism normally positioned over the slot and being precluded from movement away from the slot unless the mouth of the notch and the mouth of the slot are both directed to the top of the arm, in one embodiment aligned, and whereby if the mouth of the notch and slot are not aligned but the striker is proximate the mouths of the notch and slot and the ratchet mechanism has not engaged the stop means but is proximate thereto, movement of the pawl mechanism away from the ratchet mechanism causes the portion of the ratchet mechanism remote the notch to be engaged by the bottom arm of the pawl mechanism and align the mouth of the notch with the mouth of the slot, and when aligned, a clearance is provided between the bottom arm and portion of the ratchet mechanism remote the notch to permit the top arm to be pivoted away from over the slot, and whereby when the arm on the top of the pawl mechanism is pivoted from over the slot and rotation is attempted of the ratchet mechanism, the ratchet mechanism causes the arm on top of the pawl mechanism to be pivoted to a position over the slot thereby preventing accidental release of the striker.

According to another aspect of the invention, a hood latch assembly for securing a striker to it, is provided, the latch assembly comprising a mounting plate carrying a vertically-oriented elongated slot having a mouth opening through the top of the mounting plate and its bottom spaced from the mouth, a resiliently-biased pawl mechanism comprising a top, bottom, and two sides, pivotably secured proximate its bottom to the mounting plate on one side of the slot and a resiliently-biased ratchet mechanism rotatably-biased on the mounting plate on the other side of the slot, one side of the pawl mechanism lying closer to the ratchet mechanism than the other side, the top of the pawl mechanism carrying a curved or bent arm portion directed towards the slot and the ratchet mechanism, and overlying the slot, the bottom of the pawl mechanism carrying a curved or bent arm portion directed towards the ratchet mechanism extending below the ratchet mechanism (preferably carrying a rounded portion on the end of the arm portion), the top of the curved or bent arm portion on the top of the pawl mechanism being sloped angularly downwardly towards the ratchet mechanism, the pawl having on its side closer the ratchet mechanism a protruding detent (for example, a tooth) preferably comprising a rounded shoulder terminating in a landing below the shoulder directed towards the side of the pawl mechanism, the detent for engaging the side of the ratchet mechanism closest the pawl mechanism, the pawl secured to an actuator for pivoting the pawl mechanism and thus the detent away from the ratchet mechanism, spring means to bias the pawl mechanism to urge the top of the pawl mechanism to cover the slot and the detent towards the ratchet mechanism and the arm portion at the bottom of the pawl away from the ratchet mechanism when the actuator is released, the ratchet mechanism carrying a notch having a mouth, and a detent (for example, a tooth) below the notch, the detent preferably comprising a rounded shoulder terminating in a landing above the shoulder directed towards the ratchet mechanism, the landing of the detent on the ratchet mechanism for being engaged by the landing of the detent of the pawl mechanism for precluding rotation of the ratchet mechanism, (preferably a protruding nose on the side of the notch remote the detent and the notch proximate the landing carrying a rounded shoulder), stop means for stopping rotation of the ratchet mechanism with the mouth of the slot of the mounting plate and the mouth of the notch aligned for both receiving the striker mechanism, the ratchet mechanism carrying a portion remote the notch for being engaged by and engaging the curved or bent arm portion at the bottom of the ratchet mechanism when the curved or bent arm portion on the top of the pawl mechanism is not over the slot and rotation of the pawl is attempted and when the curved or bent arm portion is being retracted from over the slot (by, for example, the actuator) and the notch of the ratchet mechanism is not aligned with the slot, the ratchet mechanism is rotated aligning the mouth of the notch with the mouth of the slot, the pawl mechanism carrying additional means (for example, a raised handle) for pivoting the pawl mechanism, the curved or bent arm portion at the top of the pawl mechanism normally extending across the slot and being pivotable by rotation of the pawl mechanism from a position over the slot only when the mouths of the notch and the slot are aligned, without the curved or bent arm portion at the bottom of the pawl engaging the portion of the ratchet mechanism remote the notch, the portion of the ratchet mechanism remote the notch and the curved or bent arm portion being positioned relative to one another to move in a manner relative to one another (providing a clearance between the two) as the detent on the pawl mechanism engages the side of the ratchet mechanism and precludes the curved or bent arm at the top of the pawl mechanism from pivoting away from over the slot and, where the mouth of the notch and slot have been aligned and the curved or bent arm portion on the top of the pawl mechanism has been pivoted away from the slot and is restrained (for example, frozen in freezing weather) in a position away from over the slot, the rotation of the ratchet mechanism from a position where the mouth of the notch is aligned with the mouth of the slot to a position with the notch aligned with the bottom of the slot, the portion of the ratchet mechanism remote the notch engages the curved or bent arm portion at the bottom of the pawl mechanism (preferably the rounded portion), causing the curved or bent arm portion on the bottom of the pawl mechanism to be pivoted away from the ratchet mechanism pivoting the curved or bent arm portion at the top of the pawl mechanism to lie over the slot.

Thus a latch mechanism is provided whereby a striker is secured by a latch mechanism in a manner precluding accidental release of the striker in a simple, efficient, yet cost-effective manner.

Preferably, the spring means to bias the pawl mechanism to pivot the top of the pawl mechanism towards the slot comprises a spring secured to the pawl mechanism and ratchet mechanism to bias the two mechanisms in opposite directions (clockwise and counterclockwise) and urge the two structures towards one another and cause the detent on the pawl mechanism to be urged to engage the side of the ratchet mechanism closest the pawl mechanism.

Preferably, the ratchet mechanism carries a raised curved shoulder on the side of the ratchet mechanism closer the pawl mechanism between the portion of the ratchet mechanism remote the notch which engages the curved or bent arm portion at the bottom of the pawl mechanism, and the notch. When the detent on the pawl mechanism engages this rounded shoulder, the pawl mechanism is caused to pivot orienting the curved or bent arm portion at the bottom of the pawl mechanism (and preferably the rounded end of the arm) with respect to the portion of the ratchet mechanism remote the notch to ensure the curved or bent arm at the top of the pawl mechanism is not pivotable unless the mouth of the notch is aligned with the mouth of the slot for receiving a striker.

Thus it can be seen that:

(a) when the striker is not secured to the latch assembly, the ratchet is rotated to generally align the mouth of the notch with the mouth of the slot opening vertically whereby the stop means prevents further rotation of the ratchet and the bent or curved arm upon the top of the pawl mechanism proximate the mouth extends across the slot with the sloped portion of the arm over the mouth of the slot so that when a striker engages the sloped portion of the arm, the arm and thus the pawl mechanism is pivoted away from the mouth of the slot causing the mouth of the notch to be aligned with the mouth of the slot when the striker engages the sloped top of the arm on top of the pawl mechanism as the striker passes into the notch and slot;

(b) when the striker is pushed past the bent or curved arm causing the pawl mechanism to pivot to permit the striker to pass into the slot, the striker is received in the notch of the ratchet mechanism and slot, causing the ratchet mechanism to rotate, tensioning the spring mechanism and causing the striker to be urged and guided towards the bottom of the slot with the nose extending generally across the slot and notch between the bottom of the slot and mouth of the slot and with the detent of the pawl mechanism engaging the perimeter of the ratchet mechanism on the side of the notch remote the nose, positioning the pawl mechanism to cover the mouth of the slot (while the ratchet continues to rotate towards the pawl and captures the striker) in the event of breakage of the ratchet mechanism (for example, the nose thereof);

(c) when the ratchet mechanism continues to rotate by the action of the striker, the detent of the ratchet mechanism passes the detent of the pawl mechanism remote the nose thereof locking the ratchet mechanism and thereby positions the striker at the bottom of the slot remote the slot mouth, with the nose extending generally across the slot, and a clearance is provided between the portion of the ratchet mechanism remote the notch and the arm portion on the bottom of the pawl mechanism in the primary latching position;

(d) when releasing the latching mechanism by actuating the actuator to release the striker, the actuator means pivots the pawl mechanism and thus the detent (for example, tooth) away from the slot and ratchet mechanism, thereby freeing the biased ratchet mechanism to rotate with the detent of the ratchet mechanism passing the detent of the pawl mechanism to align the mouth of the notch with the mouth of the slot with the curved or bent arm carried by the top of the pawl mechanism covering the mouth of the slot, the pawl mechanism being thereafter positioned to maintain the bent arm portion over the mouth of the slot to protect against premature release of the striker by the ratchet mechanism as for example resulting from the failure thereof, the ratchet mechanism under normal conditions continuing to rotate to a position aligning the mouth of the notch with the mouth of the slot; and (e) when the curved or bent arm of the pawl mechanism is remote from the slot and the ratchet mechanism, if the pawl mechanism is ever partially restrained (for example, in freezing weather) in a position without the bent or curved arm at the top of the pawl aligned covering the slot to preclude release of the striker from the slot and the ratchet mechanism is permitted to rotate, the bottom of the ratchet mechanism engages the arm portion on the bottom of the pawl mechanism and causes the pawl mechanism to pivot to cause the bent arm to extend across the slot precluding the striker from being released until the pawl mechanism is pivoted to remove the bent arm proximate the slot out of alignment with the slot.

According to another aspect of the invention, a hood latch assembly for securing a striker to it, is provided, the latch assembly comprising a mounting plate carrying a vertically oriented slot having a mouth opening through the top of the mounting plate, a resiliently-biased pawl mechanism comprising a top, bottom, and two sides, pivotably secured proximate its bottom to the mounting plate on one side of said slot and a resiliently-biased ratchet mechanism pivotably secured to the mounting plate on the other side of the slot; one side of the pawl mechanism lying closer to the ratchet mechanism than the other side, the top of the pawl mechanism carrying a curved or bent arm portion directed towards the mouth of the slot and the ratchet mechanism, and carrying a sloped surface proximate the end of the arm on the top thereof extending to the end of the arm, the sloped surface sloping angularly towards the bottom of the pawl mechanism, the pawl having upon its side closer the ratchet mechanism, a detent (for example, a tooth) extending from the surface; the bottom of the pawl mechanism carrying a bent or curved arm directed towards the ratchet mechanism; the pawl mechanism being secured to an actuator for pivoting the pawl mechanism and thus the top curved or bent arm portion of the pawl mechanism proximate the mouth of the slot and the detent or tooth away from the slot and ratchet mechanism; spring means secured to the pawl mechanism to bias it towards the slot when the actuator is released; the pawl mechanism also carrying other means to permit pivotable movement of the pawl mechanism (preferably by hand), the rotatable ratchet mechanism rotatably biased between a locking position and a releasing position and having a top, bottom, and side portions, comprising upon its top a striker-receiving notch, a detent (for example, a tooth) on one side of the notch for engaging the detent (or tooth) on the perimeter of the pawl mechanism and preventing the ratchet mechanism from rotating when the detent of the ratchet mechanism engages the detent of the pawl mechanism,(preferably a protruding nose on the other side of the notch), the detent of the pawl mechanism in constant engagement with a side portion of the ratchet mechanism when the ratchet mechanism is permitted to rotate and the pawl mechanism is not pivoted away from the ratchet mechanism, the ratchet mechanism also carrying a portion remote the notch adjacent the bottom end of the pawl mechanism for engaging the bent or curved arm on the bottom of the pawl mechanism as the ratchet rotates in the event the pawl mechanism is pivoted laterally away from the ratchet mechanism and does not restore to its position over the slot (for example when the pawl mechanism is frozen in position) to cause the curved or bent arm on the top of the pawl mechanism proximate the slot to extend over the slot, and spring means secured to the ratchet mechanism to urge the ratchet to rotate from a position when the notch is proximate the bottom of the slot with the nose extending across the slot above the notch and with the ratchet mechanism not being restrained, to a position with the mouth of the notch between the nose and detent, generally aligned with the mouth of the slot (preferably the spring mechanism also secured to the pawl mechanism); stop means (carried preferably by the mounting plate) to stop further rotation of the ratchet mechanism when the notch of the ratchet mechanism is aligned with the mouth of the slot mechanism, whereby:

(a) when the striker is not secured to the latch assembly, the ratchet is rotated to generally align the mouth of the notch with the mouth of the slot opening vertically whereby the stop means prevents further rotation of the ratchet and the bent or curved arm upon the top of the pawl mechanism proximate the mouth extends across the slot with the sloped portion of the arm over the mouth of the slot so that when a striker engages the sloped portion of the arm, the arm and thus the pawl mechanism is pivoted away from the mouth of the slot causing the mouth of the notch to be aligned with the mouth of the slot when the striker engages the sloped top of the arm on top of the pawl mechanism, as the striker passes into the notch and slot;

(b) when the striker is pushed past the bent or curved arm causing the pawl mechanism to pivot to permit the striker to pass into the slot, the striker is received in the notch of the ratchet mechanism and slot, causing the ratchet mechanism to rotate, tensioning the spring mechanism and causing the striker to be urged and guided towards the bottom of the slot with the nose extending generally across the slot and notch between the bottom of the slot and mouth of the slot and with the detent of the pawl mechanism engaging the perimeter of the ratchet mechanism on the side of the notch remote the nose, positioning the pawl mechanism to cover the mouth of the slot (while the ratchet continues to rotate and captures the striker) in the event of breakage of the ratchet mechanism (for example, the nose thereof);

(c) when the ratchet mechanism continues to rotate by the action of the striker, the detent of the ratchet mechanism passes the detent of the pawl mechanism remote the nose thereof locking the ratchet mechanism and thereby positions the striker at the bottom of the slot remote the slot mouth with the nose extending generally across the slot in the primary latching position, and a clearance is provided between the portion of the ratchet mechanism remote the notch and the arm portion on the bottom of the pawl mechanism;

(d) when releasing the latching mechanism by actuating the actuator to release the striker, the actuator means pivots the pawl mechanism and thus the detent (for example, tooth) away from the slot and ratchet mechanism, thereby freeing the biased ratchet mechanism to rotate with the detent of the ratchet mechanism passing the detent of the pawl mechanism to align the mouth of the notch with the mouth of the slot with the curved or bent arm carried by the top of the pawl mechanism covering the mouth of the slot, the pawl mechanism being thereafter positioned to maintain the bent arm portion over the mouth of the slot to protect against premature release of the striker by the ratchet mechanism resulting from the failure thereof, the ratchet mechanism under normal conditions continuing to rotate to a position aligning the mouth of the notch with the mouth of the slot; and (e) when the curved or bent arm of the pawl mechanism is remote from the slot and the ratchet mechanism, if the pawl mechanism is ever partially restrained (for example, in freezing weather) in a position without the bent or curved arm at the top of the pawl aligned covering the slot to preclude release of the striker from the slot and the ratchet mechanism is permitted to rotate, the bottom of the ratchet mechanism engages the arm portion on the bottom of the pawl mechanism and causes the pawl mechanism to pivot to cause the bent arm to extend across the slot precluding the striker from being released until the pawl mechanism is pivoted to remove the bent arm proximate the slot out of alignment with the slot.

According to another aspect of the invention, when the mouth of the notch of said ratchet mechanism is proximate the mouth of the slot but not aligned with the mouth of the slot when the striker is to be pushed down on the top of the arm on the top of the pawl mechanism, the pawl mechanism will cause the curved arm portion upon its bottom to rotate towards said ratchet mechanism to thereby engage said portion of the ratchet mechanism remote the notch, thereby pivoting said ratchet mechanism to align the mouth of the notch with the mouth of the slot to thereby receive the striker.

Preferably the pawl mechanism has disposed upon its surface an opening, said opening being in a preferred embodiment a slot, said opening also extending through the mounting bracket and the actuator is a resiliently-biased detent mechanism secured therethrough precluding the pivoting of the pawl mechanism about its pivot until the detent mechanism is disengaged from extending through the opening extending through the mounting bracket allowing the resiliently-biased pawl mechanism to rotate (clockwise in a preferred embodiment) disengaging contact between said pawl and said ratchet mechanism whereby said ratchet mechanism is permitted to rotate (preferably counterclockwise). The pawl mechanism may also have a recess disposed upon its side remote the ratchet mechanism wherein a resiliently-biased member (such as in a preferred embodiment a coil spring) is retained (the other end of said spring being attached to the ratchet mechanism at, for example, a compatibly-positioned recess).

According to another aspect of the invention, said pawl mechanism is curved on its surface closer the ratchet mechanism to provide a pair of recesses spaced by the detent.

According to another aspect of the invention, spring means is provided to secure the ratchet mechanism to the pawl mechanism whereby when the detent of the pawl is rotated away from ratchet mechanism releasing the ratchet mechanism for rotation, the ratchet is urged to rotate by the spring to position the notch in alignment with the slot in the mounting plate thereby releasing the striker from the slot.

According to yet another aspect of the invention, the peripheral configuration of the resiliently-biased ratchet mechanism closer the pawl mechanism is irregularly-shaped and provides the notch for receiving the striker and has disposed upon the side of the notch remote the nose, a cam surface terminating in the detent which detent in a preferred embodiment, is a tooth compatibly-shaped to interact with the detent (for example, tooth) disposed upon the periphery of said pawl for engagement therewith.

Preferably the ratchet mechanism has disposed upon, within, or as part of its body or perimeter, stop means for abutting against abuttment means upon the mounting bracket to prevent over-rotation of the ratchet mechanism and ensure proper alignment thereof for the notch to receive or release the compatibly-shaped striker mechanism.

Preferably the ratchet mechanism has a recess disposed upon its surface remote the pawl mechanism wherein a resiliently-biased member such as a coil spring is retained for compatible co-operation with the pawl mechanism.

Preferably the ratchet mechanism is eccentrically mounted upon a fulcrum or pivot point secured by its extremities remote the pawl mechanism to said mounting bracket.

In a preferred embodiment, the resiliently-biased detent mechanism has a central connector having oppositely-directed arm or hook portions at the extremities thereof for co-operative engagement through the overlapping slots through the pawl mechanism and the mounting bracket, said detent mechanism being remotely disengaged from said slot within the mounting bracket allowing rotation of the pawl mechanism in a clockwise direction thereby allowing rotation of the ratchet mechanism in a counterclockwise direction to commence the release of the striker mechanism.

In an alternate embodiment of the invention both the mounting bracket and the ratchet mechanism have a compatible stop and recess stamped upon their perimeter or within the body to prevent over-rotation of the ratchet mechanism.

Further, a latch mechanism may be alternately embodied in similar manner to the aforementioned structures within the hood, trunk, or door assemblies of an automobile or alternative land vehicle. Further, the closure fastener may vary in size in use proportionally without varying from the scope of the invention. For example, one embodiment of expanded dimensions may be used to secure a tractor trailer upon the mounting bracket or hitch centrally-disposed at the rear of the tractor.

According to another aspect of the invention, the resiliently or alternately-biased pawl mechanism, has disposed upon its surface instead of a slotted opening, a recessed, or raised portion, or an alternate opening, said portion or opening securing a compatibly-shaped resiliently-biased detent mechanism, thereby precluding the rotation of said pawl mechanism, about its pivot until said detent mechanism disengages said portion or opening allowing thently-biased pawl mechanism to pivot away from the ratchet mechanism disengaging contact between the detent of the pawl the rotmechanism and the detent of the ratchet mechanism whereby said ratchet mechanism will rotate in the opposite direction.

BRIEF DESCRIPTION OF THE DRAWINGS

The invention will now be illustrated with reference to the following drawings of a preferred embodiment of the invention in which:

FIG. 7 is a front view of the latch mechanism illustrating the positions of the components if the pawl mechanism could be pivoted away from the slot with the ratchet mechanism held in position—a physical impossibility.

FIGS. 8 to 11 inclusive illustrate further respective movement of the ratchet mechanism and pawl mechanism in the striker-releasing operation.

DETAILED DESCRIPTION OF THE DRAWINGS

Figure 1:
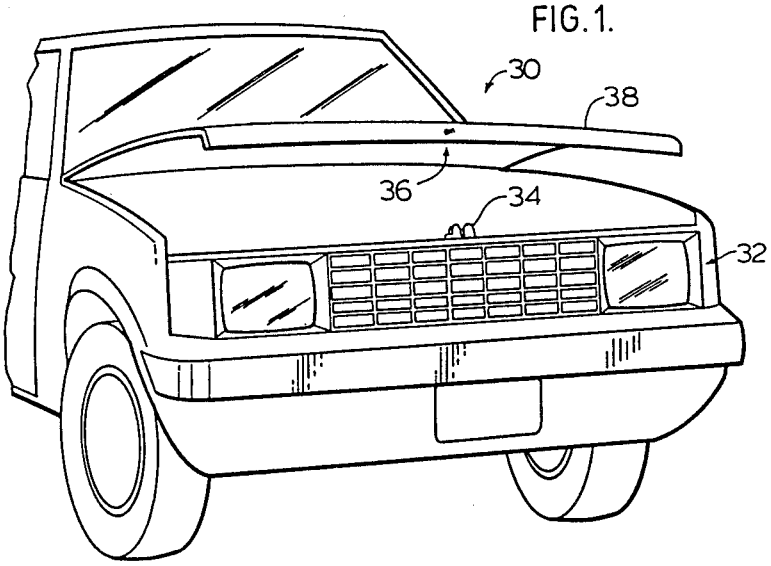
FIG. 1 is a perspective view of the front end of an automobile illustrating the mounting of a latch mechanism constructed according to a preferred embodiment of the invention as a hood latch.

With reference to FIG. 1 there is shown automobile 30 comprising a chassis 32 to which is mounted latching mechanism 34 for securing and latching striker 36 on the underside of hood 38 of automobile 30.

Figure 2:
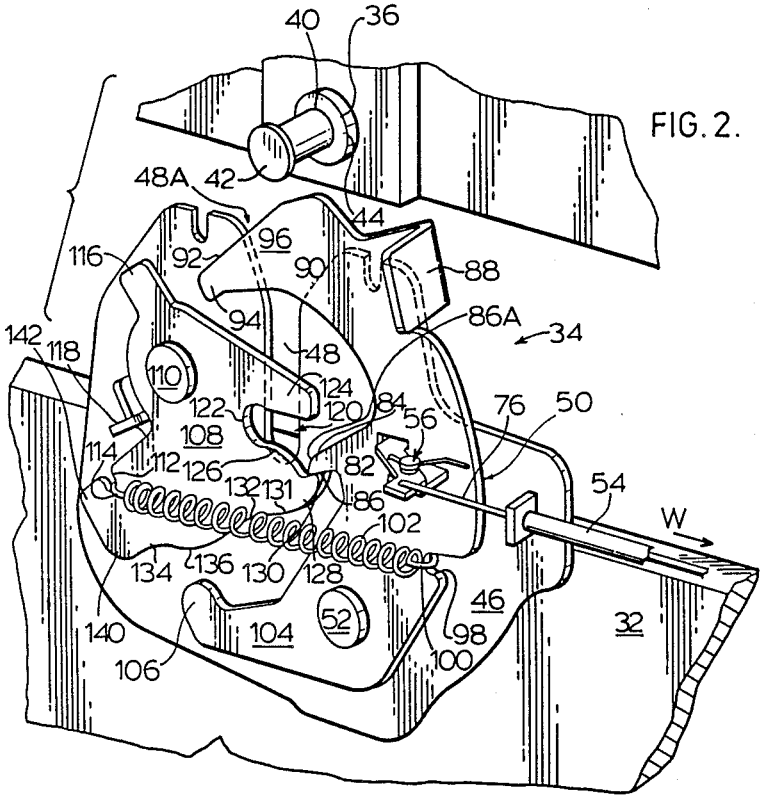
FIG. 2 is a close-up perspective view of the latch mechanism illustrated in FIG. 1, according to the preferred embodiment of the invention.

With reference to FIG. 2, latch mechanism 34 is shown for the purpose of securely latching striker assembly 36 secured to the underside of the hood 38 to extend horizontally as shown. Striker assembly 36 comprises horizontally-extending cylinder 40 and enlarged circular end portions 42 and 44, portion 44 secured to the underside of hood 38.

Latch mechanism 34 comprises mounting bracket 46 carrying vertically oriented slot 48 which is centrally located in mounting plate 46 and extends from a central middle portion upwardly and has wider mouth portion 48A. Mounting bracket 46 also carries pivotally mounted pawl mechanism 50 pivotally mounted on pivot (pin) 52 to be pivoted by actuator 54 in the direction W releasing detent mechanism 56 securing pawl mechanism 50 to mounting plate 46.

Figure 3:
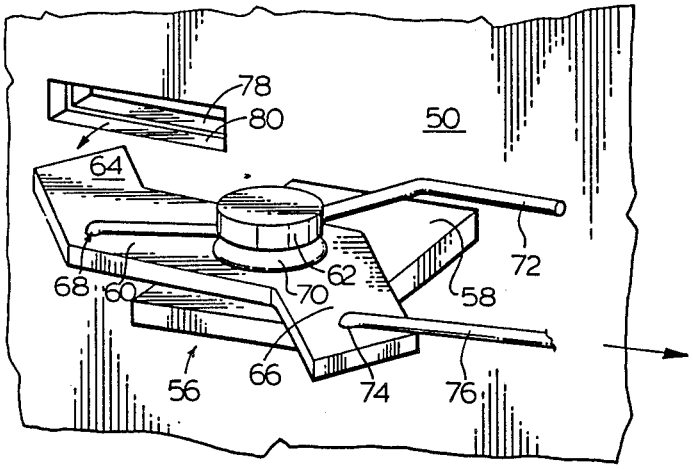
FIG. 3 is a close-up perspective view of part of the structure shown in FIG. 2.
Figure 4:
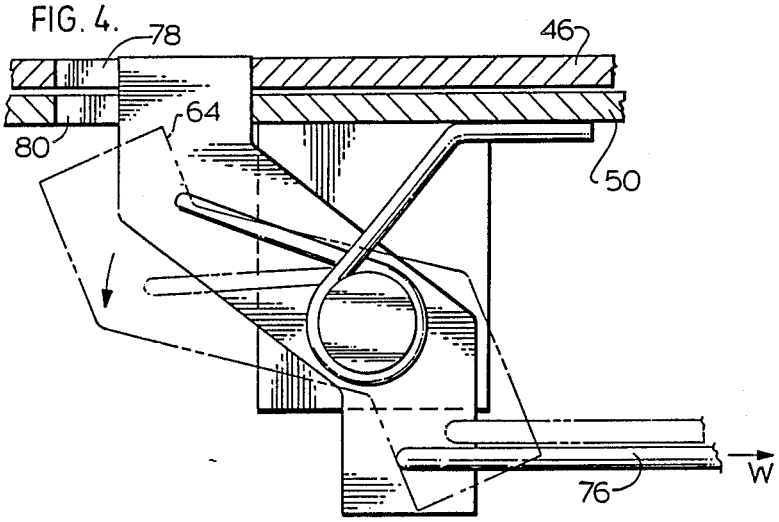
FIG. 4 is a top view of the release detent mechanism shown in FIG. 3 secured for use.

With reference to FIGS. 3 and 4 detent mechanism 56 is mounted on plate 58 extending normal to the plane of pawl mechanism 50 and comprises central body portion 60 pivoted on pivot (pin) 62 to plate 58 and carries oppositely extending arms 64 and 66, arm 64 carrying an aperture 68 for receiving one end of spring 70 wrapped around pivot 62 and the other arm 72 for abutting the face of pawl mechanism 50. Arm 66 also includes an aperture 74 for receiving rod 76 secured to actuator 54.

When pawl mechanism is in the position shown in FIG. 2, two slots, one in mounting plate 46 and identified as 78 (see FIGS. 3 and 4) and the other in pawl mechanism 50 identified as 80, are aligned with one another for receipt of arm 64 shown in FIG. 4. Thus pawl mechanism is locked in position. When arm 64 is retracted from slots 78 and 80 (slots 78 and 80 are wider than arm 64) by the rotation of arm 60 by the actuation of actuator 54, pawl 50 is rotated about pivot 52 in the direction W rotating the top portion thereof away from slot 48 and mouth 48A. Thus arm 64 has pivoted out of the slots and the movement of rod 76 in the direction W pulls plate 58 and thus pawl 50 away from slot 48. When pawl 50 is returned to the position shown in FIG. 2 and actuator 54 is released, the slots 78 and 80 are aligned and arm 64 returns into the slots for locking the pawl mechanism 50 in position.

With reference to FIG. 2, pawl mechanism 50 further comprises a central body portion 82 which carries a tooth 84 having on the top surface thereof rounded shoulder 86A and on the underside inwardly-directed straight surface 86. Pawl mechanism 50 carries proximate the top thereof handle 88 comprising a portion of the body angled at right angles to the normal plane of pawl mechanism 50 and top arm portion or safety hook portion 96 carrying on its upper surface sloped surface 92 extending to the end 94 of pawl mechanism 50 from intermediate portion 96 for the purposes of being engaged by striker 40 causing rotation of pawl mechanism 50 about pivot point 52 to permit entry of the striker mechanism 36 into slot 48. Pawl mechanism 50 also carries notch 98 on the outer surface remote tooth 84 in central portion 82 for receiving one end 100 of spring 102. On the bottom end of pawl mechanism 50 is arm 104 which includes a rounded end portion 106 and which arm 104 extends in the same direction as arm 90 away from central portion 82 which central portion extends generally upwardly. Mounting plate 46 also mounts a ratchet mechanism 108 for rotation about pivot pin 110 and is secured at notch 112 to the other end 114 of spring 102 so that when free to move the action of spring 102 (being expanded in FIG. 2) will cause a ratchet mechanism to rotate in a counterclockwise motion if permitted to do so from the position shown in FIG. 2. Striker assembly 36 is urged upwardly by the action of tension spring 102 as the ratchet mechanism rotates, elevating hood 38. Ratchet mechanism 108 also comprises stop arm 116 for engaging stop 118 secured to mounting plate 46. Ratchet mechanism 108 carries striker-receiving notch 120 defined by curved bottom portion 122, nose 124 on one side and curved rounded shoulder 126 between portion 122 and tooth 128. Tooth 128 comprises upper straight flat portion 130 for engaging portion 86 of tooth 84 on the pawl as shown in FIG. 2. Ratchet mechanism 108 also carries on the surface below tooth 128 a curved surface "the controlling surface" as shown and comprises recesses 132 and 134 between raised curved portion 136 for the purpose of engaging surface 86A. Thus the curves formed by the outer surface of ratchet mechanism 108 comprising surface 131 below tooth 128, recess 132, raised curved surface 136, recess 134, raised portion 140 and end portion 142, if engaged by surface 86A of tooth 84 of pawl mechanism 50, will control the relative positioning of the component parts of ratchet mechanism 108 with respect to pawl mechanism 50 and as will be seen, arm 104 and rounded portion 106 at the end thereof do not engage ratchet mechanism 108 except under special circumstances. Thus, surface 86A of tooth 84 acts as a cam follower and control surfaces 131, 132, 136, 134, 140 and 142 which act as the cam surfaces are followed by surface 86A.

Figure 5:
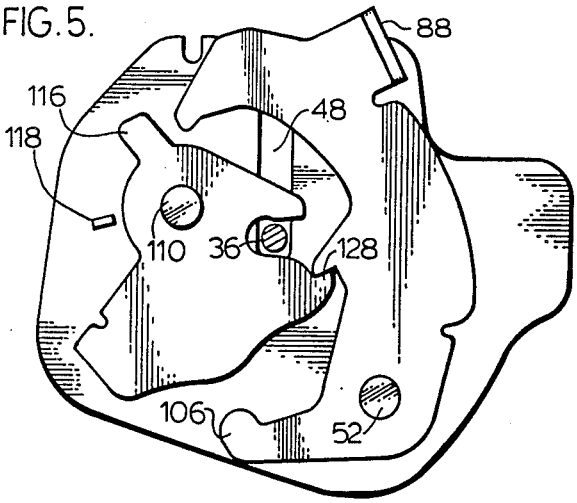
FIG. 5 is a front view of the latch mechanism of FIG. 2 illustrating the interaction of all components when the latch mechanism fully secures the striker according to the preferred embodiment of the invention.

With reference to FIG. 5, stiker 36 is in notch 120 at the bottom of slot 48 with tooth 84 engaging tooth 128 preventing relative rotation of ratchet mechanism 108 counterclockwise about pivot pin 110 by the relaxation of spring 102 pulling ratchet 108 towards pawl mechanism 50. Arm 90 of pawl mechanism 50 extends over the mouth 48A of slot 48.

Figure 6:
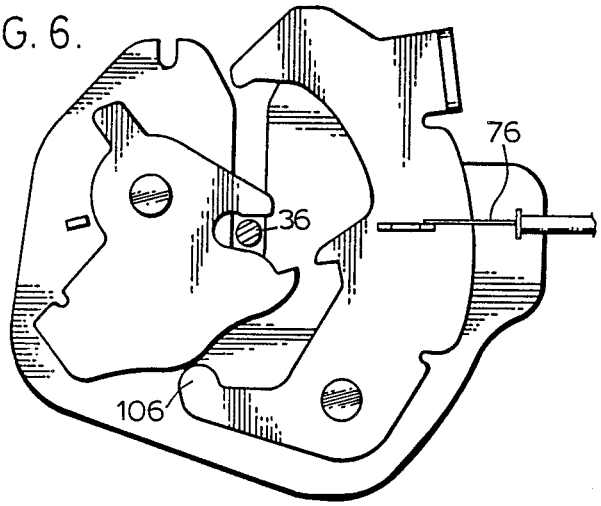
FIG. 6 is a front view of the latch mechanism of the pawl being pivoted away from the ratchet mechanism.

With reference to FIG. 6, actuator 54 has been retracted in general direction W retracting pawl mechanism 50 which pivots about pivot pin 52 withdrawing detent tooth 84 towards actuator 54 away from tooth 128, positioning latch mechanism instantaneously in a position where the ratchet mechanism is now free to rotate counterclockwise to free striker 36 urged to rise by the action of spring mechanism in hood 38. However, as latch mechanism 108 rotates in a counterclockwise direction and striker rises in slot 48 carried below nose 124 in notch 120, arm 90, including portion 94 extends across the mouth 48A of slot 48, preventing release of striker 36. As is apparent, a clearance exists between portion 106 of arm 104, and the outer controlling surface of a ratchet mechanism when pawl 90 overlies slot 48. It is also clear with reference to FIG. 7 that for arm or safety hook portion 90, including end 94 to be removed from being over the mouth 48A of slot 48, the end 106 of arm 104 *would extend beneath* ratchet mechanism 108 which is an *impossibility* because as can be seen pawl mechanism 50 and ratchet mechanism 108 are in the same plane.

With reference to FIG. 8, pawl mechanism 50 has been released by actuator 50 to permit tooth 84 and particularly outer surface 86A thereof to engage surface 131 below tooth 128 as ratchet mechanism 108 continues to rotate, controlling the position of end 106 of arm 104 to provide a clearance between the "controlling surface" and portion 106.

Figure 9:
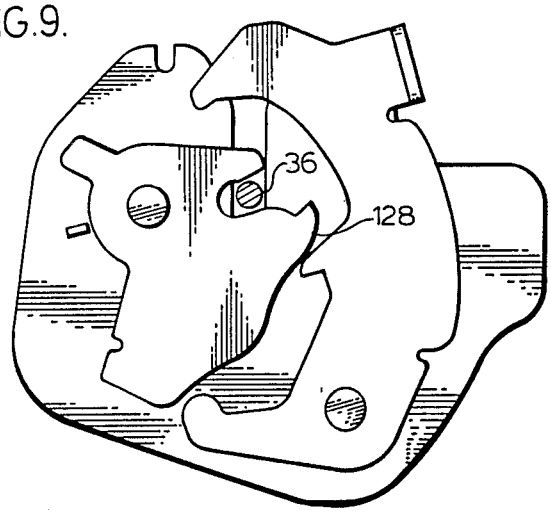
Figure 10:
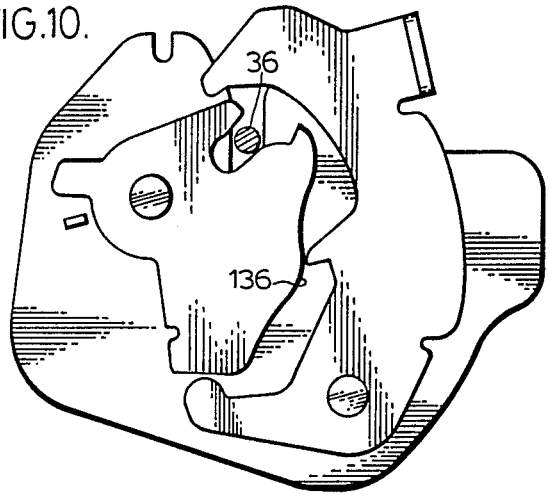
Figure 11:
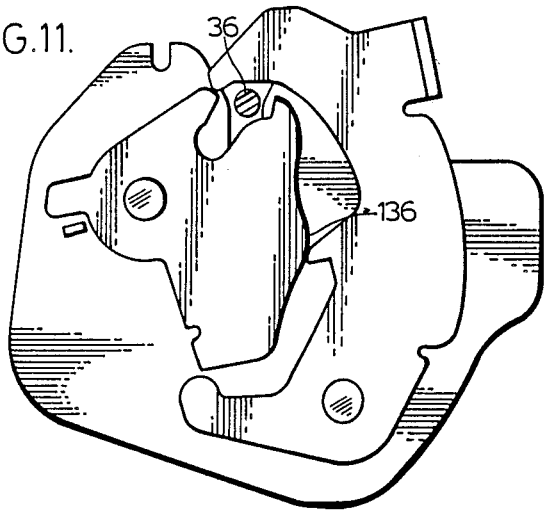
Figure 12:
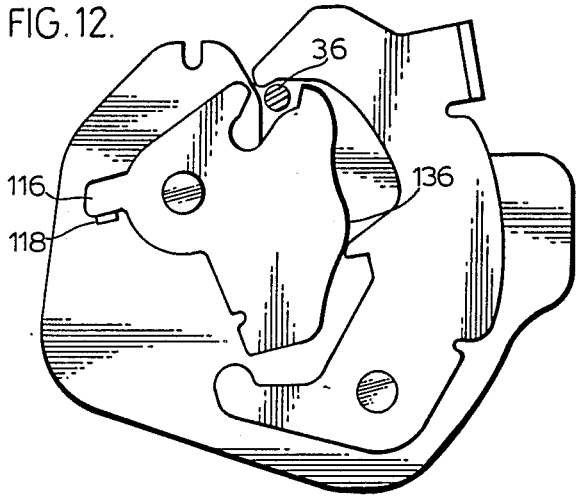
FIG. 12 is a front view of the latch mechanism prior to pivoting of the pawl mechanism to release the striker.

With reference to FIGS. 9, 10 and 11 it is clear as ratchet mechanism 108 rotates to cause arm 116 to engage stop 118, thereby aligning a notch 120 with the mouth 48A of slot 48, surface 86A engages surface 131, recess 132, rounded shoulder 136, and recess 134, constantly positioning end portion 106 of arm 104 in a position such that there is a clearance between the surfaces and portion 106 of arm 104. If the ratchet mechanism in rotating does not align notch 120 with slot 48 for the release of striker 36, as for example, a position attained in FIG. 11, because arm 116 does not engage stop 118 and pawl mechanism 50 rotated by the engaging of handle 88 and pulling it laterally to pivot arm 90 and portion 94 away from slot 48, portion 106 of arm 104 engages ratchet mechanism 108 proximate corner surface 142, rotating ratchet mechanism about pin 110 to cause arm 116 to engage stop 118 (see FIG. 12). Thereafter as pawl mechanism 50 is pivoted (see FIG. 13), arm 104 and portion 106 passes behind ratchet mechanism 108. However, if the ratchet mechanism returns to position shown in FIG. 12, arm 116 engaging stop 118, then the rotation of pawl mechanism 50 by the engagement of handle 88, will move arm 104 and portion 106 behind ratchet mechanism 108. There will be no engagement of corner 142 by portion 106.

Figure 13:
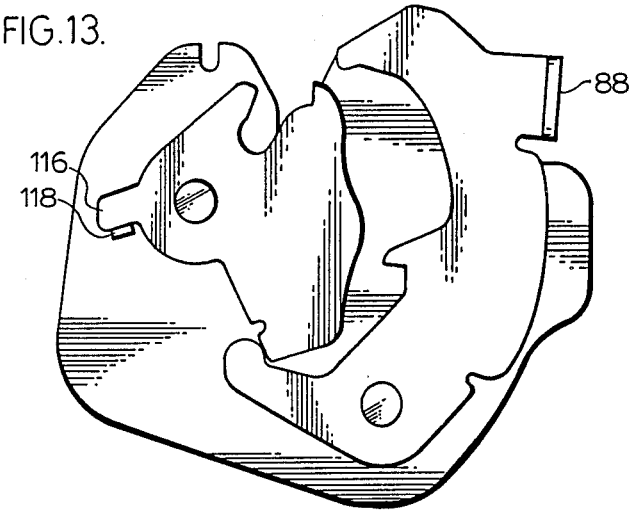
FIG. 13 illustrates the release of the striker.
Figure 14:
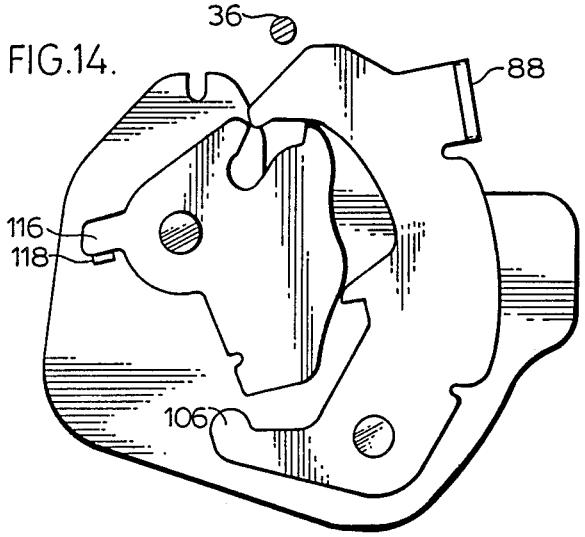
FIGS. 14 to 20 inclusive illustrate the latching operation of the latch mechanism securing the striker.

It is also clear that in the event that pawl mechanism 50 becomes frozen in the position shown in FIG. 13, if the ratchet mechanism rotates clockwise, it will engage portion 106, pushing portion 106 counterclockwise, forcing arm 90 and portion 94 over slot 48.

Figure 20:
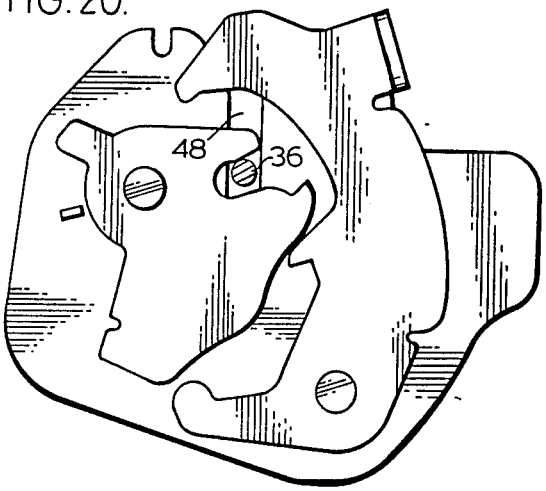

With reference to FIGS. 2 and 14 to 20 inclusive, the latching of striker 36 is clearly seen. Striker 36 is brought to bear on surface 92 of arm portion 96 which causes pawl mechanism 50 to pivot clockwise about pivot 52 until striker 36 passes into the mouth 48A of slot 48 and the mouth of notch 120 and sits on shoulder 126, forcing ratchet mechanism 108 to pivot clockwise around pivot 110. (If the notch 120 is not aligned then the pivoting of pawl mechanism 50 causes portion 106 of arm 104 to engage ratchet mechanism 50 to cause ratchet mechanism 50 to align the mouth of notch 120 with the mouth of slot 48.) As is apparent from the Figures, a clearance exists between end 106 and ratchet mechanism 108 because only tooth surface 86A of tooth 86 engages surfaces 134, 136, 132 and 131 until tooth 84 and surface 86 is caused to engage surface 130 of tooth 128 stretching spring 102 with arm 64 within slot 78 of mounting plate 46 and aligned slot 80 of pawl mechanism 50 as shown in FIG. 20.

It is thus clear that except for the instances of pawl mechanism 50 being frozen in a position not covering slot 48, or where the notch 120 is not aligned with the slot 48 and attempt is made to pivot the pawl to position arm 90 away from slot 48 or to rotate ratchet mechanism 108 counterclockwise, there will be a clearance between arm 104, portion 106 and the "controlling surfaces". In other words, except for the conditions previously specified, there will be clearance between the arm 104 and end portion 106 and ratchet mechanism 108. This clearance is as a result of surface 86A acting as a cam follower following the "controlling surfaces" on the surface of ratchet mechanism 108 closer the pawl mechanism 50. The in and out motion of tooth 86 moves arm 104 and portion 106 towards and away from ratchet 108 as relative rotation of ratchet mechanism 108 occurs, maintaining arm 90, safety hook portion 96, and end portion 94 over the slot, protecting accidental release of striker 36.

Figure 15:
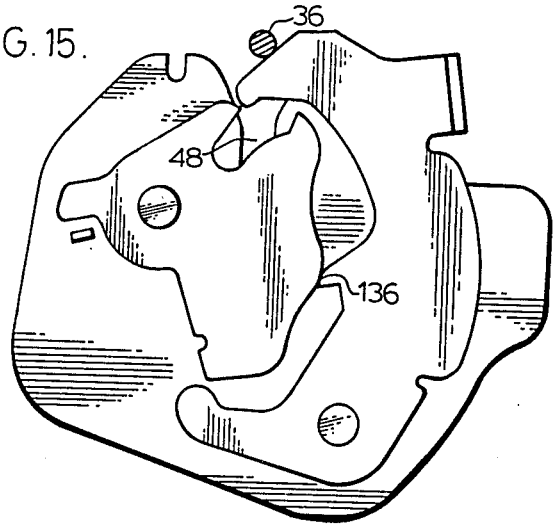
Figure 16:
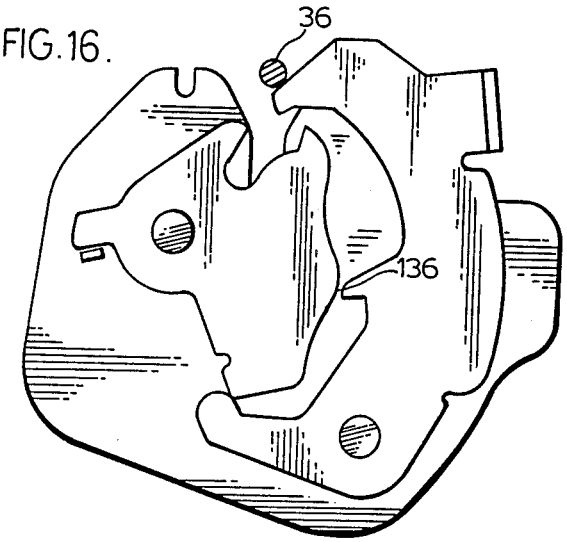
Figure 17:
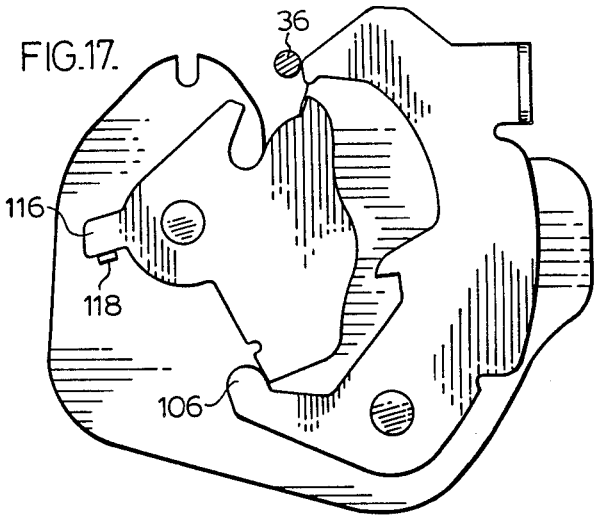
Figure 18:
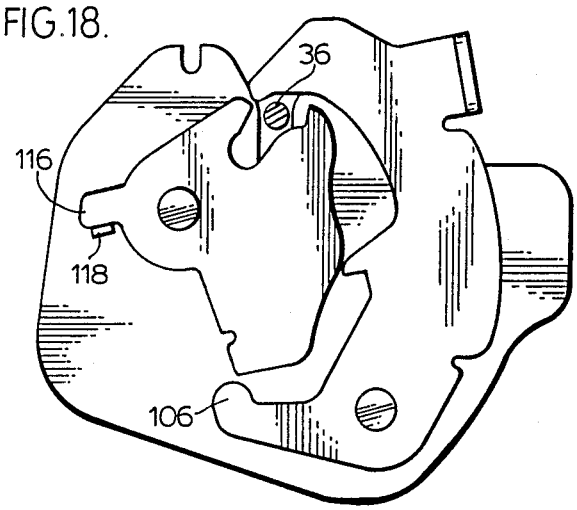
Figure 19:
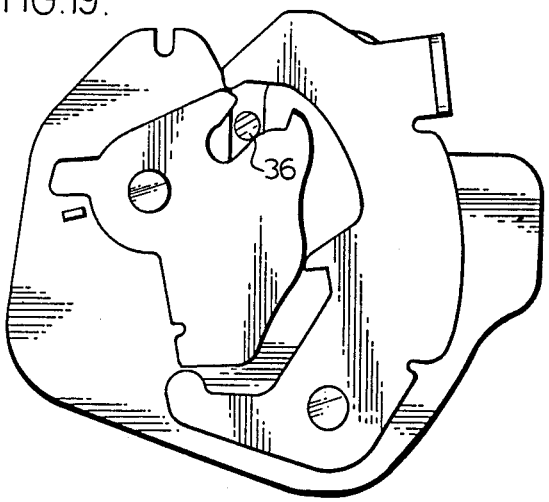

With reference to FIGS. 15, 16 and 17, where notch 120 is misaligned with slot 48, rotation of pawl mechanism 50 laterally clockwise about pin 52, causes arm 104 and rounded portion 106 to engage end portion 142 of ratchet mechanism 108 to align the notch and slot. Thereafter, portion 106 passes onto the other side of ratchet mechanism 108 remote pawl mechanism 50 having positioned the notch. Curved round shoulder 126 is thus appropriately positioned so that when striker 40 enters notch 120 and slot 48, it is guided into the notch by the shoulder 126. This shoulder receives striker 40. Pushing down moves the striker 40 into the slot 48. Shoulder 126 enhances the rotation of the ratchet mechanism 108.

As is apparent to a man skilled in the art, the construction of the tooth surface 86A and the cam surfaces and their disposition must be such as to maintain a clearance between end 106 and arm 104 and the ratchet mechanism 108 except under specific conditions. Consideration must be paid to the tolerances in the construction of the embodiment.

Figure 21:
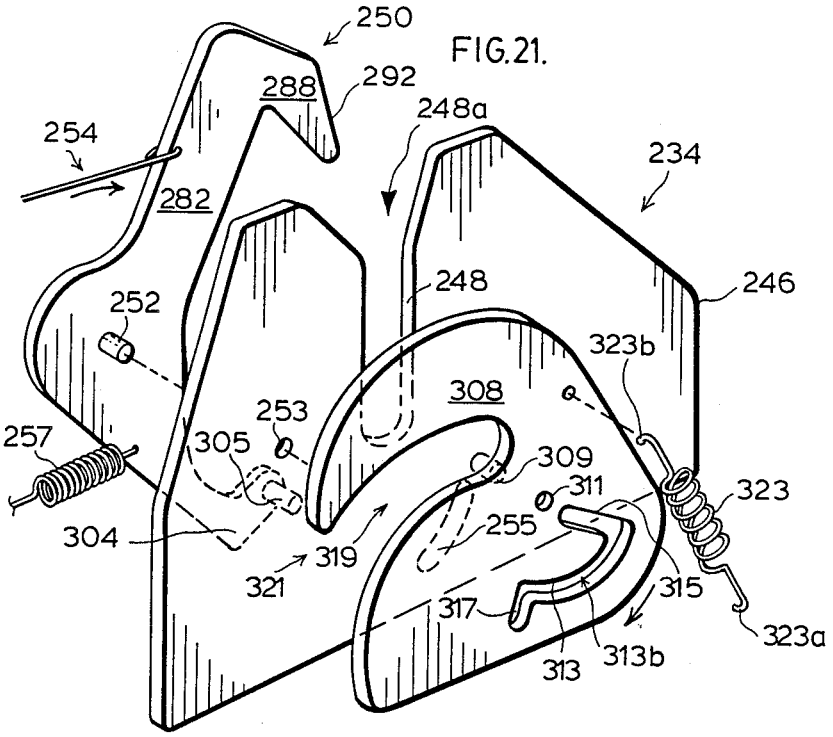
FIG. 21 is a perspective view of a latch mechanism constructed according to another embodiment of the invention.

With reference to FIG. 21, latch mechanism 234 comprises mounting plate or bracket 246 carrying curved slot 255 and vertically oriented slot 248 which is centrally located in mounting plate 246 and extends from a central middle portion upwardly and has wider mouth portion 248A. Mounting bracket 246 also carries pivotally mounted spring biased pawl mechanism 250 pivotally mounted on pivot pin 252 to be pivoted counterclockwise by actuator 254 secured to a release lever (not shown) about pin 252 mounted in aperture 253 in mounting plate 246.

Pawl mechanism 250 comprises a central body portion 282, top arm or handle 288 carrying on its upper surface, sloped surface 292 for the purposes of being engaged by striker 240 (see FIG. 22) causing counterclockwise rotation of pawl mechanism about pivot point 252 to permit entry of striker 240 into slot 248. On the bottom of pawl mechanism 250 is bottom arm 304 which includes pin 305 secured to extend through curved slot 255 through mounting bracket 246. Spring 257 is stretched when arm 250 is rotated counterclockwise about pin 252.

On the side of mounting plate 246 opposite pawl mechanism 250 but extending in a plane parallel to pawl mechanism 250 is ratchet mechanism 308. Ratchet mechanism 308 is supported for rotation by pin 309 extending from mounting plate 246 through circular aperture 311 in ratchet mechanism 308.

Modified Z-shaped slot 313 is provided in ratchet mechanism comprising centrally curved portion 313B (being a segment of a circle where center is aperture 311 and pin 309) and carrying arm portion 315 extending from centrally curved portion 313B towards apertures 311 and other arm portion 317. Z-shaped slot 313 can be aligned with slot 255 for the receipt of pin 305 extending through slot 255 in mounting plate 246 and Z-shaped slot 313. (In this regard, see FIG. 22.) Ratchet mechanism also carries notch 319 having mouth 321 into which striker 240 may be permitted to move. Spring 323 is secured at end 323A to mounting plate as shown in FIG. 1 and the other 323B secured to pawl mechanism.

Having described the components shown in FIG. 21, the operation and use of the hood latch will be described with reference to FIGS. 22 to 26 inclusive. In this regard, with the hood latch completely closed, striker 240 sits at the bottom of slot 248 in notch 319 of pawl mechanism 308 and with arm 288 of pawl mechanism 282 overlying slot mouth 248A. Pin 305 is secured at the lower end of curved slot 255 in arm portion 317 at the end thereof remote curved portion 313B. Spring 323 is stretched. Thus because of the positioning of pin 305, pawl mechanism is unable to rotate and the structure remains static until actuator 254 is pulled withdrawing arm 288 (to a slight extent) rotating pin 305 on arm portion 304 about pin 252 stretching spring 257. When pin 305 enters slot portion 313B, spring 323 starts to draw ratchet mechanism 308 clockwise about pin 309 and pin 305 is moved from proximate slot portion 317 to slot portion 315 (see FIGS. 23, 24 and 25) permitting striker 240 to rise in slot 248 (striker 240 is lifted by spring 323 for elevating the hood of a car) in position shown in FIG. 25. Pin 305 has now become aligned to be able to be moved in slot portion 315 towards pin 309 and aperture 311. With striker 240 in the position shown in FIG. 25, arm 288 of pawl 282 still extends over slot 248 preventing the striker from being dislodged therefrom until arm 282 can be further rotated. This can only be achieved when pin 305 is able to move in slot portion 315 as shown in FIG. 26, and in this regard, pawl 282 is rotated counterclockwise about pin 252 as permitted by pin 305 moving in slot 315 towards pin 309 withdrawing top arm 288 thus releasing striker 240.

Figure 22:
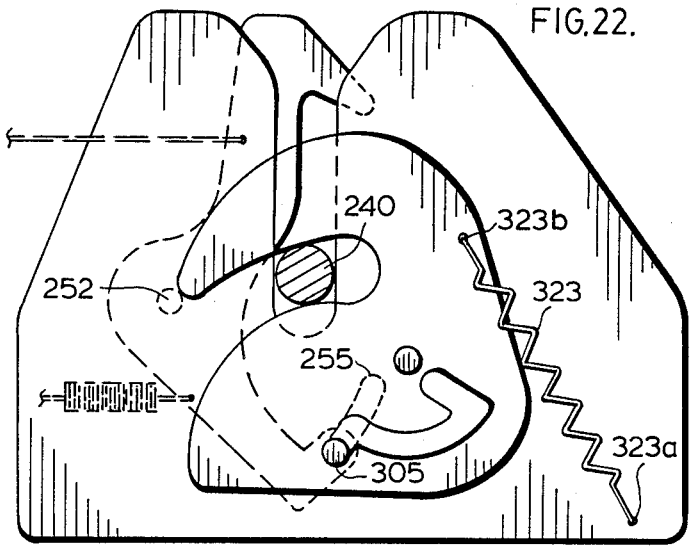
FIG. 22 is a front view of the latch mechanism of FIG. 21 illustrating the interaction of all components when the latch mechanism fully secures a striker according to the embodiment.
Figure 23:
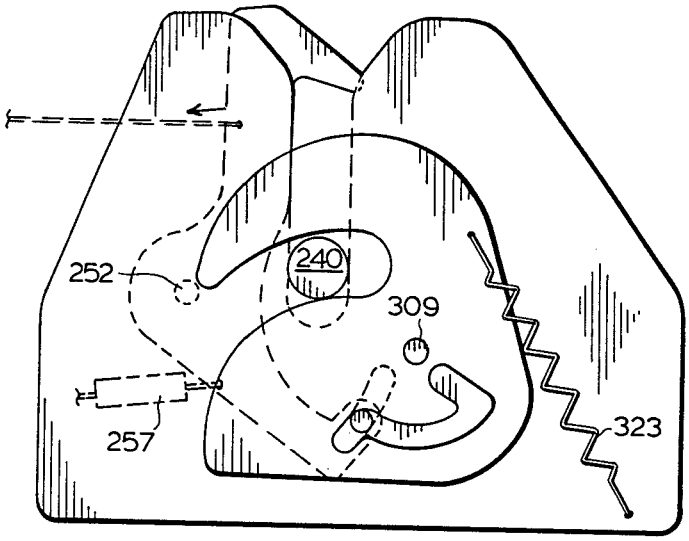
FIGS. 23 to 26 inclusive illustrate various positions of the latch mechanism in use.
Figure 24:
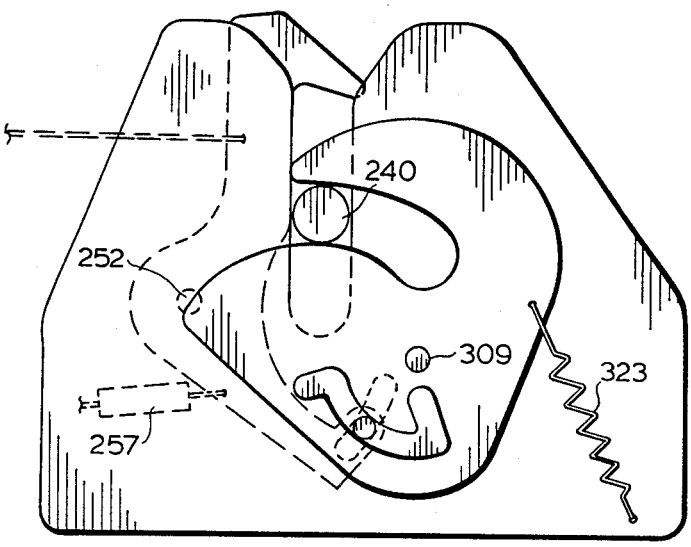
Figure 25:
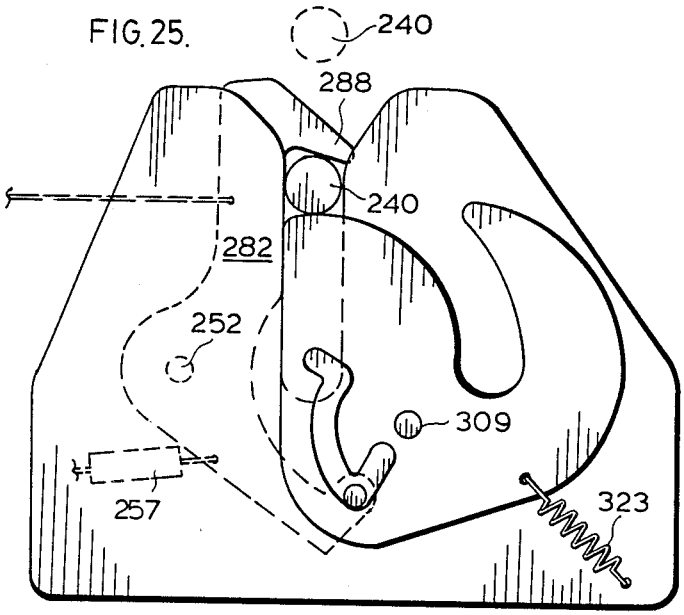
Figure 26:
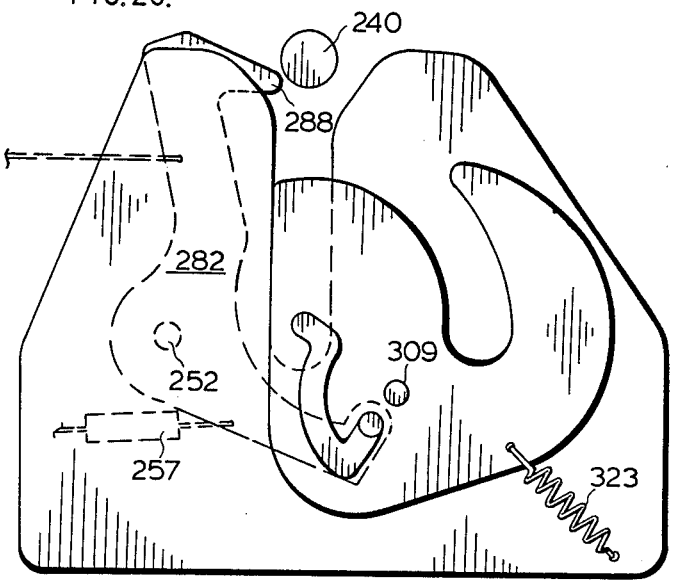

For insertion of striker 240 into slot 248 for securing striker 240 in slot 248 and in notch 319, striker (shown dotted in FIG. 25) is brought down against surface 292 of top arm 288 causes arm 288 to be moved counterclockwise rotating pin 305 in slot portion 315 towards pin 309 (as well as moving in slot 255) so that striker 240 passes nose 292 taking up the position shown in FIG. 25 in the bold lines and as the hood latch is pushed downwardly (by the pushing of the hood down to close the hood onto an automobile body) pawl 308 is caused to rotate from the position shown in FIG. 25 (after pawl arm 288 has returned to the position shown in FIG. 25) so that pin 305 rides in slot 255 and central Z-shaped slot portions 315, 313B and 317 comprising slot 313 through the position shown in FIG. 23 to the position shown in FIG. 22 where the striker is in a locked position.

As many changes can be made to the embodiments of the invention without departing from the scope of the invention, it is intended that all matter contained therein be interpreted as illustrative of the invention and not in a limiting sense.

The embodiments of the invention in which an exclusive privilege or property is claimed are as follows:

1. A latch mechanism comprising a mounting plate carrying a slot having a mouth, a pivotably-biased pawl mechanism comprising a top arm and bottom arm and centrally disposed detent, a ratchet mechanism biased for rotation carrying a notch having a mouth, a detent on one side of the notch for engaging the detent of the pawl mechanism for precluding the rotation of the ratchet mechanism, the mouth of the notch of the ratchet mechanism for aligning with the mouth of the slot for both receiving a striker, and stop means to stop the rotation of the ratchet mechanism when the mouth of the notch is aligned with the mouth of the slot to prevent over-rotation of the ratchet mechanism, the ratchet mechanism arranged for guiding the striker to proximate the bottom of the slot so that the detent of the pawl engages the detent of the ratchet mechanism precluding the ratchet mechanism from rotating to release the striker, the arm on the top of the pawl mechanism normally positioned over the slot and being precluded from movement away from the slot unless the mouth of the notch and mouth of the slot are both directed towards the top arm and whereby if the mouths of the notch and slot are not aligned but the striker is proximate the mouths of the notch and slot and the ratchet mechanism has not engaged the stop means but is proximate thereto, movement of the pawl mechanism away from the ratchet mechanism causes the portion of the ratchet mechanism remote the notch to be engaged by the bottom arm of the pawl mechanism and align the mouth of the notch with the mouth of the slot, and when aligned, a clearance is provided between the bottom arm and portion of the ratchet mechanism remote the notch to permit the top arm to be pivoted away from over the slot, and whereby when the arm on the top of the pawl mechanism is pivoted from over the slot and rotation is attempted of the ratchet mechanism, the ratchet mechanism attempts to cause the arm on top of the pawl mechanism to be pivoted to a position over the slot thereby preventing accidental release of the striker.

2. A hood latch assembly for securing a striker to it the latch assembly comprising a mounting plate carrying a vertically-oriented elongated slot having a mouth opening through the top of the mounting plate and its bottom spaced from the mouth, a resiliently-biased pawl mechanism comprising a top, bottom, and two sides, pivotably secured proximate its bottom to the mounting plate on one side of the slot and a resiliently-biased ratchet mechanism rotatably-biased on the mounting plate on the other side of the slot, one side of the pawl mechanism lying closer to the ratchet mechanism than the other side, the top of the pawl mechanism carrying a curved or bent arm portion directed towards the slot and the ratchet mechanism, and overlying the slot, the bottom of the pawl mechanism carrying a curved or bent arm portion directed towards the ratchet mechanism extending below the ratchet mechanism, the top of the curved or bent arm portion on the top of the pawl mechanism being sloped angularly downwardly towards the ratchet mechanism, the pawl having on its side closer the ratchet mechanism a protruding detent, the detent for engaging the side of the ratchet mechanism closest the pawl mechanism, the pawl secured to an actuator for pivoting the pawl mechanism and thus the detent away from the ratchet mechanism, spring means to bias the pawl mechanism to urge the top of the pawl mechanism to cover the slot and the detent towards the ratchet mechanism and the arm portion at the bottom of the pawl away from the ratchet mechanism when the actuator is released, the ratchet mechanism carrying a notch having a mouth, and a detent below the notch, the detent terminating in a landing above the shoulder directed towards the ratchet mechanism, the landing of the detent on the ratchet mechanism for being engaged by the landing of the detent of the pawl mechanism for precluding rotation of the ratchet mechanism, stop means for stopping rotation of the ratchet mechanism with the mouth of the slot of the mounting plate and the mouth of the notch aligned for both receiving the striker mechanism, the ratchet mechanism carrying a portion remote the notch for being engaged by and engaging the curved or bent arm portion at the bottom of the ratchet mechanism when the curved or bent arm portion on the top of the pawl mechanism is not over the slot and rotation of the pawl is attempted and when the curved or bent arm portion is being retracted from over the slot and the notch of the ratchet mechanism is not aligned with the slot, the ratchet mechanism is rotated aligning the mouth of the notch with the mouth of the slot, the pawl mechanism carrying additional means for pivoting the pawl mechanism, the curved or bent arm portion at the top of the pawl mechanism normally extending across the slot and being pivotable by rotation of the pawl mechanism from a position over the slot only when the mouths of the notch and the slot are aligned, without the curved or bent arm portion at the bottom of the pawl engaging the portion of the ratchet mechanism remote the notch, the portion of the ratchet mechanism remote the notch and the curved or bent arm portion being positioned relative to one another to move in a manner relative to one another (providing a clearance between the two) as the detent on the pawl mechanism engages the side of the ratchet mechanism and precludes the curved or bent arm at the top of the pawl mechanism form pivoting away from over the slot and, where the mouth of the notch and slot have been aligned and the curved or bent arm portion on the top of the pawl mechanism has been pivoted away from the slot and is restrained in a position away from over the slot, the rotation of the ratchet mechanism from a position where the mouth of the notch is aligned with the mouth of the slot to a position with the notch aligned with the bottom of the slot, the portion of the ratchet mechanism remote the notch engages the curved or bent arm portion at the bottom of the pawl mechanism, causing the curved or bent arm portion on the bottom of the pawl mechanism to be pivoted away from the ratchet mechanism pivoting the curved or bent arm portion at the top of the pawl mechanism to lie over the slot.

3. The hood latch assembly of claim 2, wherein the striker is a spring-biased striker.

4. The hood latch assembly of claim 2, wherein the curved or bent arm portion below the pawl mechanism carries a rounded portion on the end of the arm portion.

5. The hood latch assembly of claim 2, wherein the protruding detent on the side of the pawl closer the ratchet mechanism comprises a rounded shoulder terminating in the landing below the shoulder directed towards the side of the pawl mechanism.

6. The hood latch assembly of claim 2, wherein a protruding nose is provided on the side of the notch remote the detent.

7. The hood latch assembly of claim 2, wherein the spring means to bias the pawl mechanism to pivot the top of the pawl mechanism towards the slot comprises a spring secured to the pawl mechanism and ratchet mechanism to bias the two mechanisms in opposite directions and urge the two structures towards one another and cause the detent on the pawl mechanism to be urged to engage the side of the ratchet mechanism closest the pawl mechanism.

8. The hood latch assembly of claim 2, wherein the ratchet mechanism carries a raised curved shoulder on the side of the ratchet mechanism closer the pawl mechanism between the portion of the ratchet mechanism remote the notch which engages the curved or bent arm portion at the bottom of the pawl mechanism, and the notch whereby when the detent on the pawl mechanism engages this rounded shoulder, the pawl mechanism is caused to pivot orienting the curved or bent arm portion at the bottom of the pawl mechanism with respect to the portion of the ratchet mechanism remote the notch to ensure the curved or bent arm at the top of the pawl mechanism is not pivotable unless the mouth of the notch is aligned with the mouth of the slot for receiving a striker.

9. A hood latch assembly for securing a striker to it, the latch assembly comprising a mounting plate carrying a vertically oriented slot having a mouth opening through the top of the mounting plate, a resiliently-biased pawl mechanism comprising a top, bottom, and two sides, pivotably secured proximate its bottom to the mounting plate on one side of said slot and a resiliently-biased ratchet mechanism pivotably secured to the mounting plate on the other side of the slot; one side of the pawl mechanism lying closer to the ratchet mechanism than the other side, the top of the pawl mechanism carrying a curved or bent arm portion directed towards the mouth of the slot and the ratchet mechanism, and carrying a sloped surface proximate the end of the arm on the top thereof extending to the end of the arm, the sloped surface sloping angularly towards the bottom of the pawl mechanism, the pawl having upon its side closer the ratchet mechanism, a detent extending from the surface; the bottom of the pawl mechanism carrying a bent or curved arm directed towards the ratchet mechanism; the pawl mechanism being secured to an actuator for pivoting the pawl mechanism and thus the top curved or bent arm portion of the pawl mechanism proximate the mouth of the slot and the detent or tooth array from the slot and ratchet mechanism; spring means secured to the pawl mechanism to bias it towards the slot when the actuator is released; the pawl mechanism also carrying other means to permit pivotable movement of the pawl mechanism, the rotatable ratchet mechanism rotatably biased between a locking position and a releasing position and having a top, bottom, and a side portion, comprising upon its top a striker-receiving notch, a detent on one side of the notch for engaging the detent on the perimeter of the pawl mechanism and preventing the ratchet mechanism from rotating when the detent of the ratchet mechanism engages the detent of the pawl mechanism, the detent of the pawl mechanism in constant engagement with a side portion of the ratchet mechanism when the ratchet mechanism is permitted to rotate and the pawl mechanism is not pivoted away from the ratchet mechanism, the ratchet mechanism also carrying a portion remote the notch adjacent the bottom end of the pawl mechanism for engaging the bent or curved arm on the bottom of the pawl mechanism as the ratchet rotates in the event the pawl mechanism is pivoted laterally away from the ratchet mechanism and does not restore to its position over the slot to cause the curved or bent arm on the top of the pawl mechanism proximate the slot to extend over the slot, and spring means secured to the ratchet mechanism to urge the ratchet to rotate from a position when the notch is proximate the bottom of the slot with the nose extending across the slot above the notch and with the ratchet mechanism not being restrained, to a position with the mouth of the notch between the nose and detent, generally aligned with the mouth of the slot; stop means to stop further rotation of the ratchet mechanism when the notch of the ratchet mechanism is aligned with the mouth of the slot mechanism, whereby:

(a) when the striker is not secured to the latch assembly, the ratchet is rotated to generally align the mouth of the notch with the mouth of the slot opening vertically whereby the stop means prevents further rotation of the ratchet and the bent or curved arm upon the top of the pawl mechanism proximate the mouth extends across the slot with the sloped portion of the arm over the mouth of the slot so that when a striker engages the sloped portion of the arm, the arm and thus the pawl mechanism is pivoted away from the mouth of the slot causing the mouth of the notch to be aligned with the mouth of the slot when the striker engages the sloped top of the arm on top of the pawl mechanism, as the striker passes into the notch and slot;

(b) when the striker is pushed past the bent or curved arm causing the pawl mechanism to pivot to permit the striker to pass into the slot, the striker is received in the notch of the ratchet mechanism and slot, causing the ratchet mechanism to rotate, tensioning the spring mechanism and causing the striker to be urged and guided towards the bottom of the slot with the nose extending generally across the slot and notch between the bottom of the slot and mouth of the slot and with the detent of the pawl mechanism engaging the perimeter of the ratchet mechanism on the side of the notch remote the nose, positioning the pawl mechanism to cover the mouth of the slot (while the ratchet continues to rotate and captures the striker) in the event of breakage of the ratchet mechanism;

(c) when the ratchet mechanism continues to rotate by the action of the striker, the detent of the ratchet mechanism passes the detent of the pawl mechanism remote the nose thereof locking the ratchet mechanism and thereby positions the striker at the bottom of the slot remote the slot mouth with the nose extending generally across the slot in the primary latching position, and a clearance is provided between the portion of the ratchet mechanism remote the notch and the arm portion on the bottom of the pawl mechanism;

(d) when releasing the latching mechanism by actuating the actuator to release the striker, the actuator means pivots the pawl mechanism and thus the detent away from the slot and ratchet mechanism, thereby freezing the biased ratchet mechanism to rotate with the detent of the ratchet mechanism passing the detent of the pawl mechanism to align the mouth of the notch with the mouth of the slot with the curved or bent arm carried by the top of the pawl mechanism covering the mouth of the slot, the pawl mechanism being thereafter positioned to maintain the bent arm portion over the mouth of the slot to protect against premature release of the striker by the ratchet mechanism resulting from the failure thereof, the ratchet mechanism under normal conditions continuing to rotate to a position aligning the mouth of the notch with the mouth of the slot; and (e) when the curved or bent arm of the pawl mechanism is remote from the slot and the ratchet mechanism, if the pawl mechanism is ever partially restrained (for example, in freezing weather) in a position without the bent or curved arm at the top of the pawl aligned covering the slot to preclude release of the striker from the slot and the ratchet mechanism is permitted to rotate, the bottom of the ratchet mechanism engages the arm portion on the bottom of the pawl mechanism and causes the pawl mechanism to pivot to cause the bent arm to extend across the slot precluding the striker from being released until the pawl mechanism is pivoted to remote the bent arm proximate the slot out of alignment with the slot.

10. The hood latch assembly of claim 9, wherein the striker is a spring-biased striker.

11. The hood latch assembly of claim 9, wherein when the mouth of the notch of said ratchet mechanism is proximate the mouth of the slot but not aligned with the mouth of the slot when the striker is to be pushed down on the top of the arm on the top of the pawl mechanism, the pawl mechanism will cause the curved arm portion upon its bottom to rotate towards said ratchet mechanism to thereby engage said portion of the ratchet mechanism remote the notch, thereby pivoting said ratchet mechanism to align the mouth of the notch with the mouth of the slot to thereby receive the striker.

12. The hood latch assembly of claim 1, wherein the pawl mechanism has disposed upon its surface an opening, said opening being in a preferred embodiment a slot, said opening also extending through the mounting bracket and the actuator is a resiliently-biased detent mechanism secured therethrough precluding the pivoting of the pawl mechanism about its pivot until the detent mechanism is disengaged from extending through the opening extending through the mounting bracket allowing the resiliently-biased pawl mechanism to rotate disengaging contact between said pawl and said ratchet mechanism whereby said ratchet mechanism is permitted to rotate.

13. The hood latch assembly of claim 2, wherein the pawl mechanism has disposed upon its surface an opening, said opening being in a preferred embodiment a slot, said opening also extending through the mounting bracket and the actuator is a resiliently-biased detent mechanism secured therethrough precluding the pivoting of the pawl mechanism about its pivot until the detent mechanism is disengaged from extending through the opening extending through the mounting bracket allowing the resiliently-biased pawl mechanism to rotate disengaging contact between said pawl and said ratchet mechanism whereby said ratchet mechanism is permitted to rotate.

14. The hood latch assembly of claim 9, wherein the pawl mechanism has disposed upon its surface an opening, said opening being in a preferred embodiment a slot, said opening also extending through the mounting bracket and the actuator is a resiliently-biased detent mechanism secured therethrough precluding the pivoting of the pawl mechanism about its pivot until the detent mechanism is disengaged from extending through the opening extending through the mounting bracket allowing the resiliently-biased pawl mechanism to rotate, disengaging contact between said pawl and said ratchet mechanism whereby said ratchet mechanism is permitted to rotate.

15. The hood latch assembly of claim 1, wherein the pawl mechanism is curved on its surface closer the ratchet mechanism to provide a pair of recesses spaced by the detent.

16. The hood latch assembly of claim 2, wherein the pawl mechanism is curved on its surface closer the ratchet mechanism to provide a pair of recesses spaced by the detent.

17. The hood latch assembly of claim 9, wherein the pawl mechanism is curved on its surface closer the ratchet mechanism to provide a pair of recesses spaced by the detent.

18. The latch assembly of claim 1, wherein spring means is provided to secure the ratchet mechanism to the pawl mechanism whereby when the detent of the pawl is rotated away from ratchet mechanism releasing the ratchet mechanism for rotation, the ratchet is urged to rotate by the spring to position the notch in alignment with the slot in the mounting plate thereby releasing the striker from the slot (the striker mechanism being spring-loaded for ease of release).

19. The latch assembly of claim 2, wherein spring means is provided to secure the ratchet mechanism to the pawl mechanism whereby when the detent of the pawl is rotated away from ratchet mechanism releasing the ratchet mechanism for rotation, the ratchet is urged to rotate by the spring to position the notch in alignment with the slot in the mounting plate thereby releasing the striker from the slot (the striker mechanism being spring-loaded for ease of release).

20. The latch assembly of claim 9, wherein spring means is provided to secure the ratchet mechanism to the pawl mechanism whereby when the detent of the pawl is rotated away from ratchet mechanism releasing the ratchet mechanism for rotation, the ratchet is urged to rotate by the spring to position the notch in alignment with the slot in the mounting plate thereby releasing the striker from the slot (the striker mechanism being spring-loaded or ease of release).

21. The hood latch assembly of claim 1, wherein the peripheral configuration of the resiliently-biased ratchet mechanism closer the pawl mechanism is irregularly-shaped and provides the notch for receiving the striker and has disposed upon the side of the notch remote the nose, a cam surface terminating in the detent which detent in a preferred embodiment, is a tooth compatibly-shaped to interact with the detent disposed upon the periphery of said pawl for engagement therewith.

22. The hood latch assembly of claim 2, wherein the peripheral configuration of the resiliently-biased ratchet mechanism closer the pawl mechanism is irregularly-shaped and provides the notch for receiving the striker and has disposed upon the side of the notch remote the nose, a cam surface terminating in the detent which detent in a preferred embodiment, is a tooth compatibly-shaped to interact with the detent disposed upon the periphery of said pawl for engagement therewith.

23. The hood latch assembly of claim 9, wherein the peripheral configuration of the resiliently-biased ratchet mechanism closer the pawl mechanism s irregularly-shaped and provides the notch for receiving the striker and has disposed upon the side of the notch remote the nose, a cam surface terminating in the detent which detent in a preferred embodiment, is a tooth compatibly-shaped to interact for engagement therewith.

24. The hood latch assembly of claim 1, wherein the ratchet mechanism has disposed upon, within, or as part of its body or perimeter, stop means for abutting against abuttment means upon the mounting bracket to prevent over-rotation of the ratchet mechanism and ensure proper alignment thereof for the notch to receive or release the compatibly-shaped striker mechanism.

25. The hood latch assembly of claim 2, wherein the ratchet mechanism has disposed upon, within, or as part of its body or perimeter, stop means for abutting against abuttment means upon the mounting bracket to prevent over-rotation of the ratchet mechanism and ensure proper alignment thereof for the notch to receive or release the compatibly-shaped striker mechanism.

26. The hood latch assembly of claim 9, wherein the ratchet mechanism has disposed upon, within, or as part of its body or perimeter, stop means for abutting against abuttment means upon the mounting bracket to prevent over-rotation of the ratchet mechanism and ensure proper alignment thereof for the notch to receive or release the compatibly-shaped striker mechanism.

27. The hood latch assembly of claim 12, wherein the resiliently-biased detent mechanism has a central connector having oppositely-directed arm or hook portions at the extremities thereof for co-operative engagement through the overlapping slots through the pawl mechanism and the mounting bracket, said detent mechanism being remotely disengaged from said slot within the mounting bracket allowing rotation of the pawl mechanism in a clockwise direction thereby allowing rotation of the ratchet mechanism in a counterclockwise direction to commence the release of the striker mechanism.

28. The hood latch assembly of claim 13, wherein the resiliently-biased detent mechanism has a central connector having oppositely-directed arm or hook portions at the extremities thereof for co-operative engagement through the overlapping slots through the pawl mechanism and the mounting bracket, said detent mechanism being remotely disengaged from said slot within the mounting bracket allowing rotation of the pawl mechanism in a clockwise direction thereby allowing rotation of the ratchet mechanism in a counterclockwise direction to commence the release of the striker mechanism.

29. The hood latch assembly of claim 14, wherein the resiliently-biased detent mechanism has a central connector having oppositely-directed arm or hook portions at the extremities thereof for co-operative engagement through the overlapping slots through the pawl mechanism and the mounting bracket, said detent mechanism being remotely disengaged from said slot within the mounting bracket allowing rotation of the pawl mechanism in a clockwise direction thereby allowing rotation of the ratchet mechanism in a counterclockwise direction to commence the release of the striker mechanism.

30. The hood latch assembly of claim 12, wherein the resiliently or alternately-biased pawl mechanism, has disposed upon its surface instead of a slotted opening, a recessed, or raised portion, or an alternate opening, said portion or opening securing a compatibly-shaped resiliently-biased detent mechanism, thereby precluding the rotation of said pawl mechanism, about its pivot until said detent mechanism disengages said portion or opening allowing the resiliently-biased pawl mechanism to pivot away from the ratchet mechanism disengaging contact between the detent of the pawl mechanism and the detent of the ratchet mechanism whereby said ratchet mechanism will rotate in the opposite direction.

31. The hood latch assembly of claim 13, wherein the resiliently or alternately-biased pawl mechanism, has disposed upon its surface instead of a slotted opening, a recessed, or raised portion, or an alternate opening, said portion or opening securing a compatibly-shaped resiliently-biased detent mechanism, thereby precluding the rotation of said pawl mechanism, about its pivot until said detent mechanism disengages said portion or opening allowing the resiliently-biased pawl mechanism to pivot away from the ratchet mechanism disengaging contact between the detent of the pawl mechanism and the detent of the ratchet mechanism whereby said ratchet mechanism will rotate in the opposite direction.

32. The hood latch assembly of claim 14, wherein the resiliently or alternately-biased pawl mechanism, has disposed upon its surface instead of a slotted opening, a recessed, or raised portion, or an alternate opening, said portion or opening securing a compatibly-shaped resiliently-biased detent mechanism, thereby precluding the rotation of said pawl mechanism, about its pivot until said detent mechanism disengages said portion or opening allowing the resiliently-biased pawl mechanism to pivot away from the ratchet mechanism disengaging contact between the detent of the pawl mechanism and the detent of the ratchet mechanism whereby said ratchet mechanism will rotate on the opposite direction.

33. A latch mechanism comprising, (a) a mounting plate carrying a slot having a bottom and mouth, (b) a pivotably biased pawl mechanism comprising a top arm portion arranged for pivoting from a position over the slot to a position spaced from it, a bottom arm portion and follower means, (c) a ratchet mechanism biased for rotation and carrying a notch having a mouth and control means for controlling the follower means of the pawl mechanism, and (d) stop means with the latch mechanism for stopping rotation of the ratchet mechanism with the mouth of the notch proximate the mouth of the slot both directed towards the top arm portion of the pawl, the top arm portion normally positioned over the slot and being precluded from movement away from the slot unless the mouth of the notch and mouth of the slot are both directed towards the top arm portion.

34. The latch mechanism of claim 33 wherein the control means for controlling the follower means of the pawl mechanism comprises a control surface on the ratchet mechanism and the follower means comprises a detent carried at the side edge of the pawl mechanism to engage the control surface to (a) lock the ratchet mechanism with any striker in the slot and notch at the bottom of the slot with the top arm covering the slot mouth, and (b) ensure the top arm portion cannot be pushed away from over the slot unless the mouth of the notch and mouth of the slot are both proximate one another and directed toward the top arm portion.

35. The latch mechanism of claim 33 wherein the control means for controlling the follower means comprises a control structure or formation carried by the ratchet mechanism and the follower means comprises a pin carried by the pawl mechanism.

36. The latch mechanism of claim 35 wherein the control structure or formation comprises a Z-shaped slot formation through the body of the ratchet mechanism.

37. A latch mechanism comprising a mounting plate carrying a slot having a bottom and mouth, a pivotably-biased pawl mechanism comprising a top arm portion (for pivoting from a position over the slot to a position spaced from it), a bottom arm portion, and follower and engaging means, a ratchet mechanism biased for rotation and carrying a notch having a mouth and control means for controlling the follower and said engaging means on the pawl mechanism and stop means to stop the rotation of the ratchet mechanism, the ratchet mechanism arranged for guiding the striker to proximate the bottom of the slot, the arm on the top of the pawl mechanism normally positioned over the slot and being precluded from movement away from the slot by the control means of the ratchet mechanism unless the mouth of the notch and mouth of the slot are both directed towards the top arm portion.

38. The latch mechanism of claim 37 wherein the follower and engaging means comprises a centrally disposed detent.

39. The latch mechanism of claim 37 wherein the follower and engaging means comprises a pin or projection extending from the bottom arm and projecting through a slot in the mounting plate.

40. The latch mechanism of claim 37 wherein the plane of the ratchet lies in the same plane as the pawl mechanism.

41. The latch mechanism of claim 38 wherein the plane of the ratchet lies in the same plane as the pawl mechanism.

42. The latch mechanism of claim 37 wherein the plane of the ratchet lies in a plane spaced by the mounting plate from and is parallel to the plane of the pawl mechanism.

43. The latch mechanism of claim 39 wherein the plane of the ratchet lies in a plane spaced by the mounting plate from and is parallel to the plane of the pawl mechanism.

44. The latch mechanism of claim 37 or 39 wherein the control means comprises a substantially Z-shaped slot through the body of the ratchet mechanism for receiving the projection, the substantially Z-shaped slot comprising a centrally curved portion, being an arc of a circle about the pivot of the ratchet mechanism, a forward arm portion in communication with the centrally curved portion for carrying the projection when the notch of the ratchet mechanism is aligned with the bottom of the slot of the mounting plate and a rearward arm portion in communication with the centrally curved portion for permitting the top arm of the pawl mechanism to pivot from a position over the slot in the mounting plate to a position spaced from it.

45. The latch mechanism of claim 37 or 38 wherein the bottom arm portion comprises engaging means whereby if the mouths of the notch and slot are not aligned but the striker is proximate the mouths of the notch and slot and the ratchet mechanism has not engaged the stop means but is proximate thereto, movement of the pawl mechanism away from the ratchet mechanism remote the notch will engage the ratchet mechanism by the engaging means of the bottom arm portion of the pawl mechanism and align the mouth of the notch with the mouth of the slot.

46. The latch mechanism of claim 44 wherein the bottom arm portion comprises engaging means further comprising a projection or pin whereby if the mouths of the notch and slot are not aligned but the striker is proximate the mouths of the notch and slot and the ratchet mechanism has not engaged the stop means but is proximate thereto, pivoting of the pawl mechanism causes the projection or pin to move in the centrally curved portion to its rearward position, thereby positioning the ratchet to release the striker from the notch wherein the control means of the ratchet will permit the top arm of the pawl to be pivoted away from over the slot.

47. A latch mechanism comprising, (a) a mounting plate carrying a slot having a bottom and a mouth, (b) a pivotably-biased pawl mechanism comprising, (i) a top arm for pivoting from a normal position over the slot to a position spaced from it, (ii) a bottom arm, and, (iii) follower and engaging means, and (c) a ratchet mechanism biased for rotation and carrying, (i) a notch having a mouth, the notch for receiving for example the striker, and (ii) control means for controlling the follower and said engaging means on the pawl mechanism, the ratchet mechanism arranged for guiding the striker to proximate the bottom of the slot, the arm on the top of the pawl mechanism normally positioned over the slot and being precluded from movement away from the slot by the control means of the ratchet mechanism unless the mouth of the notch and mouth of the slot are both directed towards the top arm.

48. The latch mechanism of claim 47 wherein the follower and engaging means comprises a centrally disposed detent.

49. The latch mechanism of claim 42 wherein the follower and engaging means comprises a pin or projection extending from the bottom arm and projecting through a control slot in the mounting plate.

50. The latch mechanism of claim 49 wherein the control means comprises a substantially Z-shaped slot through the body of the ratchet mechanism for receiving the projection, the substantially Z-shaped slot comprising a centrally curved portion being an arc of a circle about the pivot of the ratchet mechanism), a forward arm portion in communication with the centrally curved portion for carrying the projection when the notch of the ratchet mechanism is aligned with the bottom of the slot of the mounting plate for stopping the striker at the bottom of the slot and a rearward arm portion in communication with the centrally curved portion for carrying the projection permitting the top arm of the pawl mechanism to pivot from a position over the slot in the mounting plate to a position spaced from it when the mouth of the notch of the ratchet mechanism is aligned with the mouth of the slot.

51. The latch mechanism of claim 49 wherein when the striker is guided to proximate the bottom of the slot, the detent of the pawl mechanism engages the detent of the ratchet mechanism.

52. The latch mechanism of claim 50 wherein when the striker is guided to proximate the bottom of the slot, the projection is in the forward arm portion in communication with the centrally curved portion so that the ratchet mechanism is precluded from rotating to release the striker.

* * * * *